US007679775B2

(12) United States Patent
Tsukuba et al.

(10) Patent No.: US 7,679,775 B2
(45) Date of Patent: Mar. 16, 2010

(54) Z-FOLD METHOD AND IMAGE FORMING APPARATUS

(75) Inventors: Tomoyuki Tsukuba, Tokyo (JP); Shuuichi Kimura, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 977 days.

(21) Appl. No.: 11/043,234

(22) Filed: Jan. 27, 2005

(65) Prior Publication Data

US 2005/0187088 A1 Aug. 25, 2005

(30) Foreign Application Priority Data

Feb. 3, 2004 (JP) ..... 2004-027233

(51) Int. Cl.
*G06K 15/00* (2006.01)

(52) U.S. Cl. ..... 358/1.18; 358/3.26; 358/462; 382/289; 382/290; 382/294; 382/296

(58) Field of Classification Search ..... 358/1.18, 358/528, 538, 449, 451, 453, 462; 462/61, 462/23, 19; 270/5.01, 6, 8, 20.1, 39.06–39.07, 270/42, 58.23, 58.26; 271/9.01, 9.06, 184–187; 399/407

See application file for complete search history.

(56) References Cited

U.S. PATENT DOCUMENTS 4,705,496 A * 11/1987 Bay ..... 493/320
5,768,677 A 6/1998 Natsume
5,769,404 A * 6/1998 Kanou et al. ..... 270/37
5,905,935 A * 5/1999 Wakamatsu et al. ..... 399/407
6,027,107 A 2/2000 Natsume et al.
7,386,269 B2 * 6/2008 Miyazaki ..... 399/405
2002/0051205 A1 * 5/2002 Teranishi et al. ..... 358/1.18
2003/0184806 A1 * 10/2003 Nara et al. ..... 358/1.18
2003/0227652 A1 * 12/2003 Masaki ..... 358/1.18
2005/0031392 A1 * 2/2005 Yamamoto et al. ..... 400/62
2006/0133844 A1 * 6/2006 Konno ..... 399/82

FOREIGN PATENT DOCUMENTS

JP 9-227021 9/1997
JP 10-245151 9/1998
JP 11-038712 2/1999
JP 2001-188443 7/2001
JP 2002232677 A * 8/2002
JP 2003-223087 8/2003

* cited by examiner

*Primary Examiner*—Mark K Zimmerman
*Assistant Examiner*—Javier J Ramos
(74) *Attorney, Agent, or Firm*—Oblon, Spivak, McClelland, Maier & Neustadt, L.L.P.

(57) ABSTRACT

An image forming apparatus is provided with an orientation setting part for setting a readable orientation of a document that enables an operator of the image forming apparatus to readily read and understand an image on the document when carrying out an image forming process to form the image on a recording medium, a folding direction setting part for setting a folding direction in which a Z-fold of the recording medium is to be made after the image forming process, and a Z-fold part for forming the Z-fold on the recording medium, based on the readable orientation and the folding direction.

20 Claims, 18 Drawing Sheets

FIG.20

| | TOP LEFT | BOTTOM LEFT | OBLIQUE TOP LEFT | 2-LEFT | TOP RIGHT |
|---|---|---|---|---|---|
| RIGHT-FOLD | ○ | ○ | ○ | ○ | × |
| BOTTOM-FOLD | ○ | × | × | × | ○ |

FIG.21

| | BOTTOM RIGHT | OBLIQUE TOP RIGHT | 2-RIGHT | 2-TOP | CENTER |
|---|---|---|---|---|---|
| RIGHT-FOLD | × | × | × | × | × |
| BOTTOM-FOLD | × | ○ | × | ○ | × |

FIG.22

| | TOP | RIGHT | LEFT |
|---|---|---|---|
| RIGHT-FOLD | × | × | ○ |
| BOTTOM-FOLD | ○ | × | × |

Z-FOLD METHOD AND IMAGE FORMING APPARATUS

BACKGROUND OF THE INVENTION

This application claims the benefit of a Japanese Patent Application No. 2004-027233 filed Feb. 3, 2004, in the Japanese Patent Office, the disclosure of which is hereby incorporated by reference.

1. Field of the Invention

The present invention generally relates to Z-fold methods and image forming apparatuses and Z-fold methods, and more particularly to a Z-fold method for automatically folding a transfer sheet or medium such as paper, and an image forming apparatus which employs such a Z-fold method to fold the transfer sheet or medium when ejecting the same.

2. Description of the Related Art

Recently, an image forming apparatus (hereinafter referred to as a composite apparatus) integrally comprising the functions of a printing apparatus (or printer), a copying apparatus, a facsimile apparatus, a scanning apparatus (or scanner) and the like, has been developed. Such a composite apparatus has a display part, a printing part, an image pickup (or imaging) part and the like that are provided within a housing. In addition, the composite apparatus is provided with 4 kinds of application programs (hereinafter simply referred to as applications) respectively corresponding to the printing apparatus, the copying apparatus, the facsimile apparatus and the scanning apparatus. The composite apparatus functions as the printing apparatus, the copying apparatus, the facsimile apparatus and the scanning apparatus by switching the applications.

A Z-fold function is one of various functions provided by the composite apparatus. The Z-fold function automatically folds a transfer sheet or medium such as paper (hereinafter referred to as a recording medium) when ejecting the recording medium from the composite apparatus. For example, if an A3-size document coexists within A4-size documents, the Z-fold function is used to fold the A3-size document so as to match the sizes of the documents.

But the conventional Z-fold function was not always useful due to limitations posed on the folding. For example, the Z-fold may be possible with respect to the A3-size document but not with respect to the A4-size document, and the Z-fold desired by the operator (or user) may not be possible.

SUMMARY OF THE INVENTION

Accordingly, it is a general object of the present invention to provide a novel and useful Z-fold method and image forming apparatus, in which the problems described above are suppressed.

Another and more specific object of the present invention is to provide a Z-fold method and an image forming apparatus, which can provide useful Z-fold functions to the operator (or user).

Still another and more specific object of the present invention is to provide an image forming apparatus comprising an orientation setting part configured to set a readable orientation of a document that enables an operator of the image forming apparatus to readily read and understand an image on the document when carrying out an image forming process to form the image on a recording medium; a folding direction setting part configured to set a folding direction in which a Z-fold of the recording medium is to be made after the image forming process; and a Z-fold part configured to form the Z-fold on the recording medium, based on the readable orientation and the folding direction. According to the image forming apparatus of the present invention, it is possible to provide useful Z-fold functions to the operator (or user).

A further object of the present invention is to provide a Z-fold method for an image forming apparatus, comprising an orientation setting step setting a readable orientation of a document that enables an operator of the image forming apparatus to readily read and understand an image on the document when carrying out an image forming process to form the image on a recording medium; a folding direction setting step setting a folding direction in which a Z-fold of the recording medium is to be made after the image forming process; and a Z-fold step forming the Z-fold on the recording medium, based on the readable orientation and the folding direction. According to the Z-fold method of the present invention, it is possible to provide useful Z-fold functions to the operator (or user).

Another object of the present invention is to provide a computer-readable storage medium which stores a program for causing a computer to carry out a Z-fold in an image forming apparatus, the program comprising an orientation setting procedure causing the computer to set a readable orientation of a document that enables an operator of the image forming apparatus to readily read and understand an image on the document when carrying out an image forming process to form the image on a recording medium; a folding direction setting procedure causing the computer to set a folding direction in which a Z-fold of the recording medium is to be made after the image forming process; and a Z-fold procedure causing the computer to form the Z-fold on the recording medium, based on the readable orientation and the folding direction. According to the computer-readable storage medium of the present invention, it is possible to provide useful Z-fold functions to the operator (or user).

Other objects and further features of the present invention will be apparent from the following detailed description when read in conjunction with the accompanying drawings.

BRIEF DESCRIPTION OF THE DRAWINGS

FIG. 20 is a diagram showing a staple table;

FIG. 21 is a diagram showing a staple table; and

FIG. 22 is a diagram showing a punch table.

DESCRIPTION OF THE PREFERRED EMBODIMENTS

Figure 1:
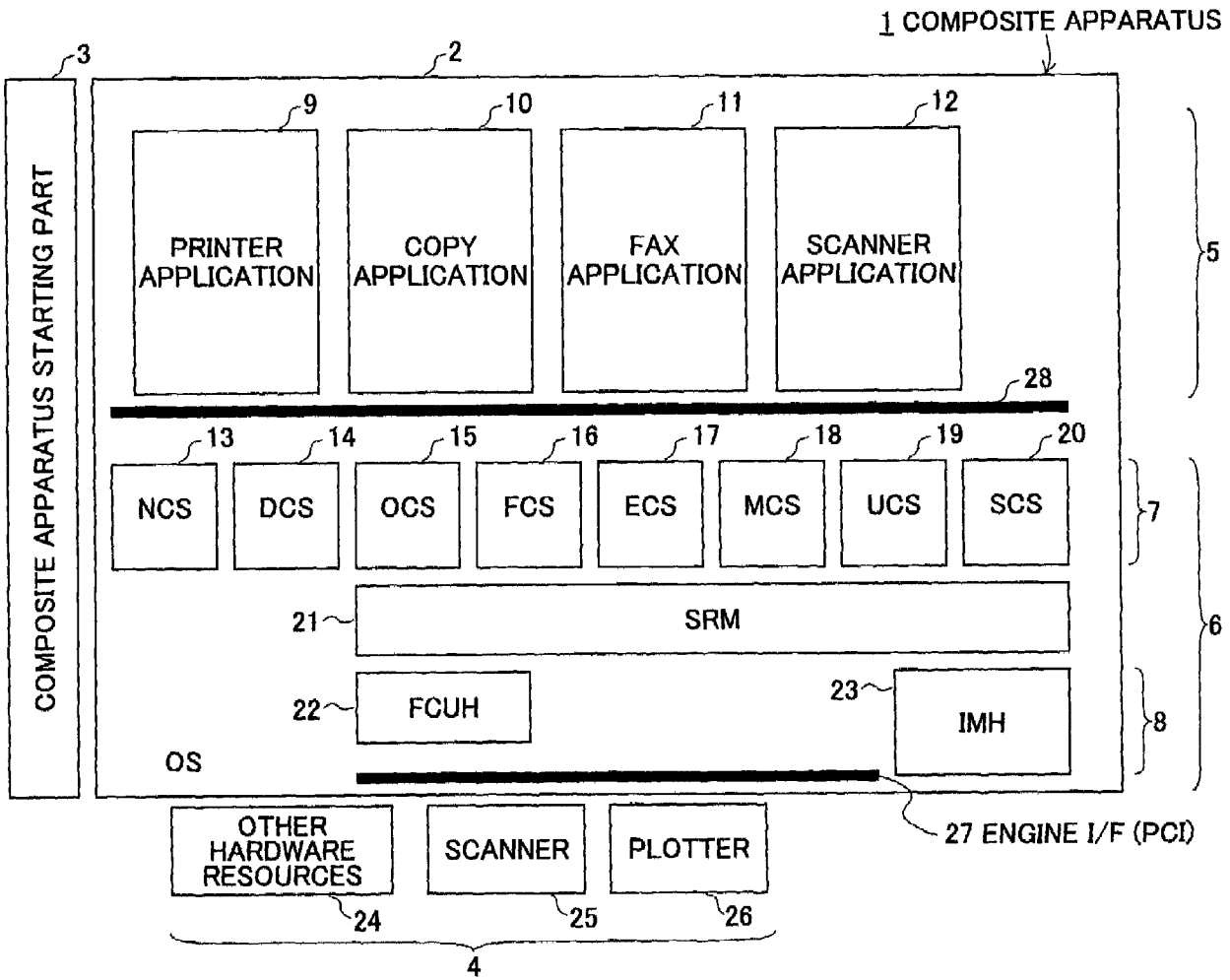
FIG. 1 is a system block diagram showing a functional structure of an embodiment of an image forming apparatus according to the present invention.

A description will be given of a functional structure of an embodiment of an image forming apparatus according to the present invention, by referring to FIG. 1. FIG. 1 is a diagram for explaining the functional structure of this embodiment of the present invention. In this embodiment, the present invention is applied to a composite (or multi-function) apparatus 1.

The composite apparatus 1 shown in FIG. 1 includes a software group 2, a composite apparatus starting (booting) part 3, and hardware resources 4. The software group 2 includes an application layer 5 and a platform layer 6 that are started in an Operating System (OS) such as a UNIX (registered trademark) OS. The hardware resources 4 include other hardware resources 24, a scanner 25 and a plotter 26. The other hardware resources 24 include a folding mechanism for folding recording media such as paper, a stapler for stapling the recording media, a puncher for punching holes in the recording media, an Automatic Document Feeder (ADF) and the like.

The composite apparatus starting part 3 is first executed when a power supply of the composite apparatus 1 is turned ON, and starts the application layer 5 and the platform layer 6. For example, the composite apparatus starting part 3 reads programs of the application layer 5 and the platform layer 6 from a Hard Disk Drive (HDD) or the like, transfers each read program to a memory region and starts (boots) each program.

The application layer 5 includes application programs (or applications) for carrying out processes peculiar to user services related to image formation, such as printing, copying, facsimile and scanning processes. More particularly, the application layer 5 includes a printer application 9 for the printing process, a copy application 10 for the copying process, a facsimile application 11 for the facsimile process, and a scanner application 12 for the scanning process.

The platform layer 6 includes a control service layer 7, a System Resource Manager (SRM) 21, and a handler layer 8. The control service layer 7 analyzes processing requests from the application layer 5, and generates acquisition requests for the hardware resources 4. The SRM 21 manages one or more hardware resources 4, and carries out an arbitration of the acquisition requests from the control service layer 7. The handler layer 8 manages the hardware resources 4 depending on the acquisition request from the SRM 21.

The control service layer 7 is formed by one or a plurality of service modules. More particularly, the control service layer 7 includes a Network Control Service (NCS) 13, a Delivery Control Service (DCS) 14, an Operation panel Control Service (OCS) 15, a Fax Control Service (FCS) 16, an Engine Control Service (ECS) 17, a Memory Control Service (MCS) 18, a User information Control Service (UCS) 19, and a System Control Service (SCS) 20.

The platform layer 6 includes an Application Program Interface (API) 28 that enables reception of the processing requests from the application layer 5 by predefined functions. The OS executes each software of the application layer 5 and the platform layer 6 in parallel as processes.

The NCS 13 provides services that may be used in common by the applications which require the network Input/Output (I/O) or interface (I/F). The processes carried out by the NCS 13 include distributing the data received from the network by each protocol to each application, and intervening when the data is sent from each application to the network.

For example, the NCS 13 may use a Hypertext Transfer Protocol Daemon (httpd) so as to control a data communication with a network equipment that is connected via the network by a HyperText Transfer Protocol (HTTP).

The DCS 14 carries out processes including control of distribution and the like of stored documents. The OCS 15 carries out processes including control of an operation panel forming an information transmitting part or means between the operator and a main body control. The FCS 16 provides the Application Program Interface (API) for facsimile transmission and reception using a Public Switched Telephone. Network or Integrated Services Digital Network (PSTN/ISDN) from the application layer 5, registration and/or reference of various facsimile data managed in a backup memory, facsimile reading, and facsimile reception printing.

The ECS 17 carries out processes corresponding to a Z-fold part or means, to control an engine part such as the scanner 25, the plotter 26 and the other hardware resources 24. The Z-fold part or means includes a rotating part or means, a size judging part or means, and a scan width comparing part or means. The MCS 18 carries out a memory control. More particularly, the MCS 18 carries out control processes such as acquiring and releasing a memory, and utilizing the HDD. The UCS 19 manages user information.

The SCS 20 carries out a plurality of functions that include application management, operating part control, system screen display, Light Emitting Diode (LED) display, hardware resource management, interrupt application control and the like.

The SRM 21 carries out the system control and the hardware resource management of the hardware resources 4 together with the SCS 20. The SRM 21 carries out an arbitration of the acquisition requests received from a higher layer that utilizes the hardware resources 4 such as the scanner 25 and the plotter 26, and executes the requests.

More particularly, the SRM 21 judges whether or not the hardware resource 4 requested by the acquisition request exists and is usable (not in use by another request), and if in the affirmative, notifies the higher layer that the requested hardware resource 4 is usable. In addition, the SRM 21 may carry out a scheduling of the hardware resources 4 that are used with respect to the acquisition request from the higher layer, and directly execute the requested contents (for example, transporting paper and forming an image by a printer engine, securing a memory, generating a file, etc.).

The handler layer 8 includes a Fax Control Unit Handler (FCUH) 22 for managing a Fax Control Unit (FCU) 40 which will be described later, and an Image Memory Handler (IMH) 23 for allocating the memory with respect to each process and for managing the allocated memory. The SRM 21 and the FCUH 22 make processing requests with respect to the hardware resources 4 by predefined functions, using an engine interface (I/F) 27 that enables transmission of the processing requests with respect to the hardware resources 4.

In the composite apparatus 1, the processes required in common by each of the applications may be centrally processed in the platform layer 6.

Figure 2:
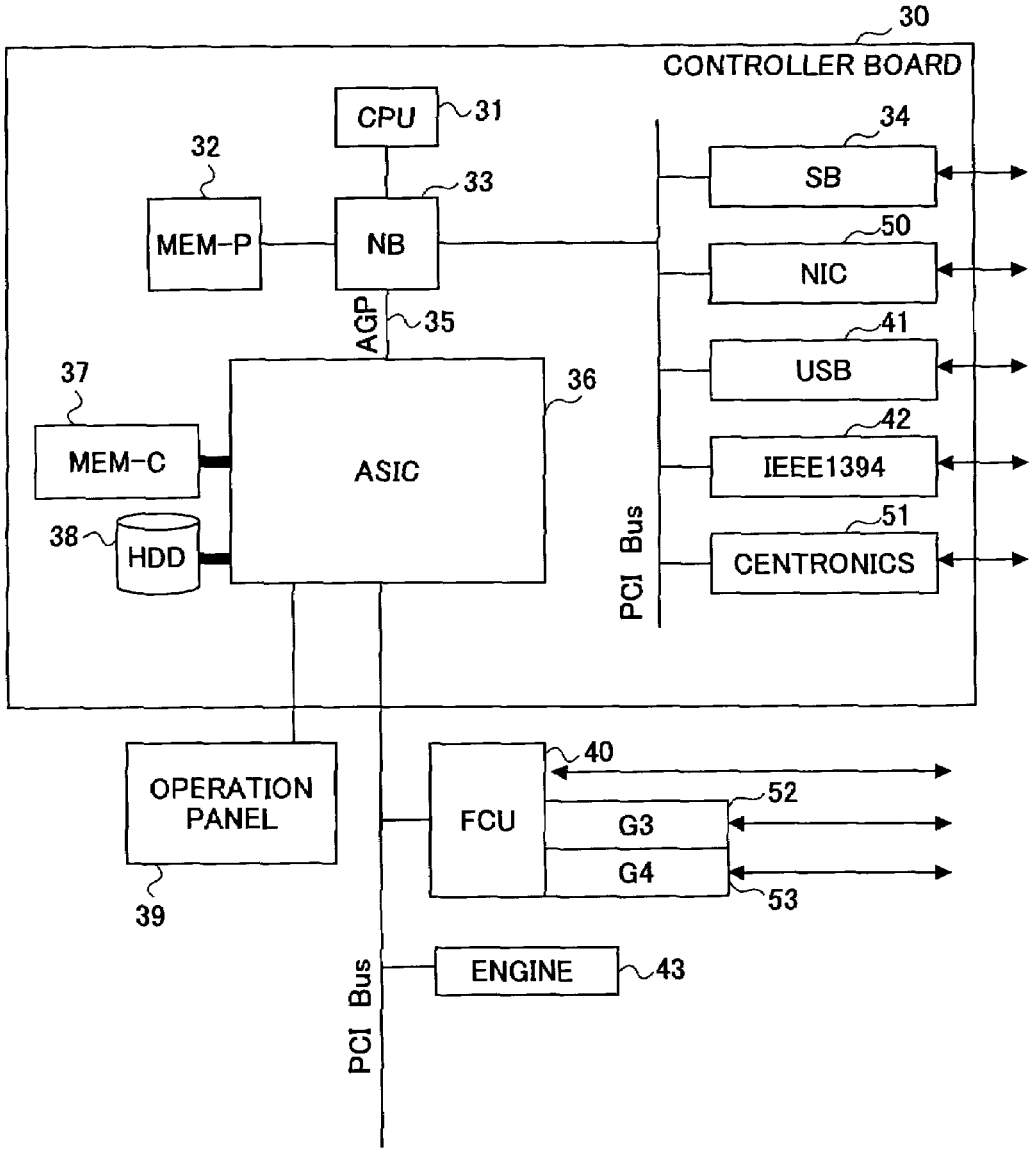
FIG. 2 is a system block diagram showing a hardware structure of the embodiment of the image forming apparatus according to the present invention.

Next, a description will be given of a hardware structure of this embodiment of the image forming apparatus, by referring to FIG. 2. FIG. 2 is a system block diagram for explaining the hardware structure of this embodiment of the image forming apparatus, namely, the composite apparatus 1.

As shown in FIG. 2, the composite apparatus 1 includes a controller board 30, an operation panel 39, the FAX control unit (FCU) 40, and an engine part 43. The FCU 40 includes a unit 52 in conformance with the G3 standards (or specifications), and a unit 53 in conformance with the G4 standards.

The controller board 30 includes a Central Process Unit (CPU) 31, a system memory (MEM-P) 32, a North Bridge (NB) 33, a South Bridge (SB) 34, an Application Specific Integrated Circuit (ASIC) 36, a local memory (MEM-C) 37, an HDD 38, a Universal Serial Bus (USB) device 41, an IEEE 1394 device 42, a Network Interface Card (NIC) 50, and a Centronics device 51.

The operation panel 39 is connected to the ASIC 36 of the controller board 30. The SB 34, the NIC 50, the USB device 41, the IEEE 1394 device 42 and the Centronics device 51 are connected to the NB 33 via a Peripheral Component Interconnect (PCI) bus.

The FCU 40 and the engine part 43 are connected to the ASIC 36 of the controller board 30 via a PCI bus.

In the controller board 30, the local memory 37, the HDD 38 and the like are connected to the ASIC 36. The CPU 31 and the ASIC 36 are connected via the NB 33 of a CPU chip set. By connecting the CPU 31 and the ASIC 36 via the NB 33 in this manner, it is possible to cope with a case where the interface of the CPU 31 itself is unknown.

The ASIC 36 and the NB 33 are not simply connected via the PCI bus, but are connected via an Accelerated Graphics Port (AGP) 35. The ASIC 36 and the NB 33 are connected via the AGP 35 to prevent a performance deterioration that would otherwise occur if the two were connected by the low-speed PCI bus, since the composite apparatus 1 is designed to execute and control one or a plurality of processes forming the application layer 5 and the platform layer 6 shown in FIG. 1.

The CPU 31 controls the general operation of the composite apparatus 1. More particularly, the CPU 31 starts and executes, on the OS, the NCS 13, the DCS 14, the OCS 15, the FCS 16, the ECS 17, the MCS 18, the UCS 19, the SCS 20, the SRM 21, the FCUH 22 and the IMH 23, as processes. The CPU 31 also starts and executes the printer application 9, the copy application 10, the facsimile application 11 and the scanner application 12 which form the application layer 5.

The NB 33 is provided to connect the CPU 31 to the system memory 32, the SB 34 and the ASIC 36. The system memory 32 is used as a plotting memory and the like of the composite apparatus 1. The SB 34 connects the NB 33 to the PCI bus, a peripheral device and the like. The local memory 37 is used as an image buffer for copying, a code buffer and the like.

The ASIC 36 includes image processing hardware elements for carrying out image processing. The HDD 38 forms a storage for storing image data (document data), programs, font data, forms, documents and the like. The operation panel 39 includes keys for accepting an input operation made by the operator (or user), and a display part for displaying messages and the like with respect to the operator. In this embodiment, the operation panel 39 forms an orientation setting part or means and a folding direction setting part or means.

Next, a description will be given of the Z-fold. First, a description will be given of the definitions of the terms "size of document data", "recording medium size", "readable orientation", "non-readable orientation", "right-fold", "bottom-fold", "vertical" and "horizontal", and a basic Z-fold operation.

The "size of document data" refers to the recording medium size such as the A4-size and the B5-size to which the image data (document data) read from the document (hereinafter referred to as document data) conforms when being formed on the recording medium. The "recording medium size" refers to the recording medium size such as the A4-size and the B5-size. Hence, the scanning widths of the document data and the recording medium correspond to the recording medium size such as the A4-size and the B5-size. In addition, the document data and the recording medium are regarded as being aligned in the "same direction" (or as having the "same orientation"), if a longer side (or shorter side) of the recording medium to which the document data conforms when being formed on the recording medium is parallel to the longer side (or shorter side) of the recording medium on which the image of the document data is formed.

The "readable orientation" refers to an orientation of the document that enables the operator (or user) of the composite apparatus 1 to readily read and understand the image on the document when carrying out a copying process, for example, to form this image on a recording medium. On the other hand, the "non-readable orientation" refers to an orientation of the document that does not enable the operator (or user) of the composite apparatus 1 to readily read and understand the image on the document when carrying out the copying process, for example, to form this image on the recording medium.

Figure 3:
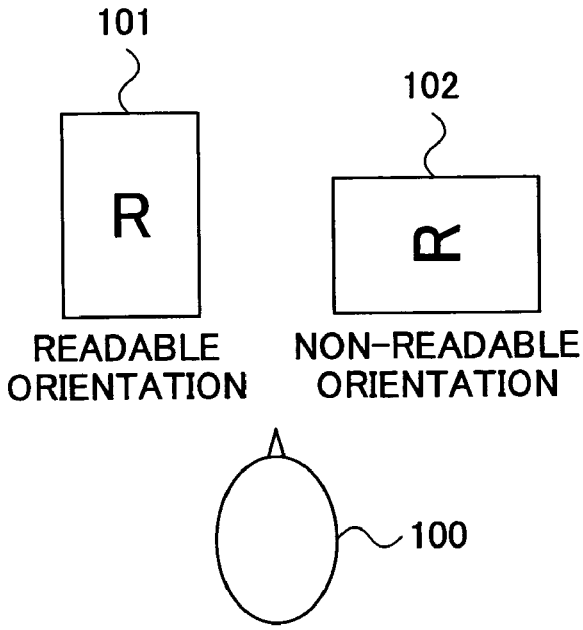
FIG. 3 is a diagram for explaining readable and non-readable orientations.

FIG. 3 is a diagram for explaining the readable and non-readable orientations. FIG. 3 shows a document 101 having "R" written thereon, and a document 102 having "R" written thereon. When an operator (or user) 100 of the composite apparatus 1 carries out a copying process, for example, the documents 101 and 102 are viewed by the operator 100 in the orientations shown in FIG. 3. FIG. 3 shows the operator 100 and the documents 101 and 102 in a plan view, that is, from immediately above the documents 101 and 102. Although the orientations of the documents 101 and 102 are mutually different, the documents 101 and 102 are actually the same in that "R" is written on both. When viewed from the operator 100, the document 101 can be readily read and understood by the operator 100, while the document 102 cannot be readily read and understood by the operator 100 since the "R" appears sideways. Therefore, the document 101 is in the readable orientation, and the document 102 is in the non-readable orientation.

Figure 4:
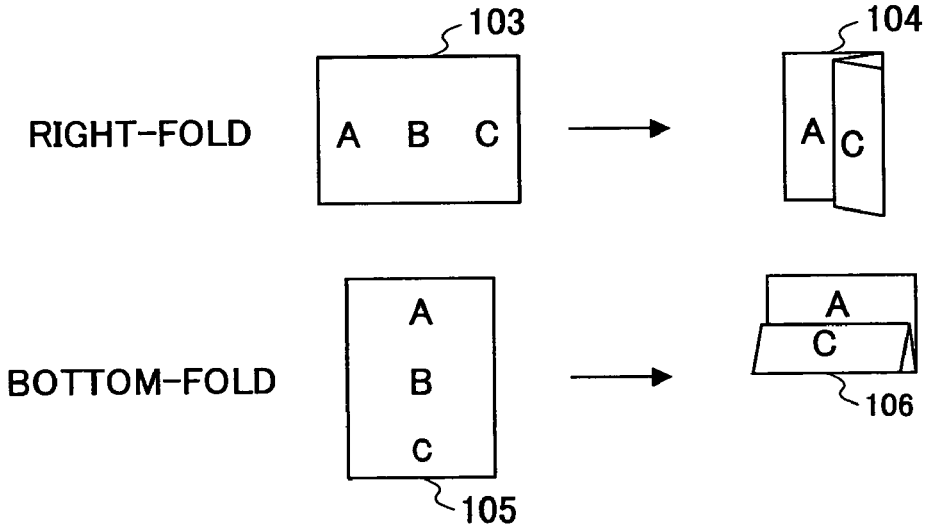
FIG. 4 is a diagram for explaining a right-fold and a bottom-fold.

FIG. 4 is a diagram for explaining the "right-fold" and the "bottom-fold". FIG. 4 shows documents 103 and 105, and Z-folded recording media 104 and 106. As shown in FIG. 4, the right-fold folds the right side (or portion) of the recording medium 104 corresponding to the document 103 in the readable orientation, and the bottom-fold folds the bottom side (or portion) of the recording medium 106 corresponding to the document 105 in the readable orientation. The bottom-fold of the recording medium 104 corresponding to the document 103 in the readable orientation and the right-fold of the recording medium 106 corresponding to the document 105 in the readable orientation are prohibited, as will be described hereunder with reference to FIG. 5.

Figure 5:
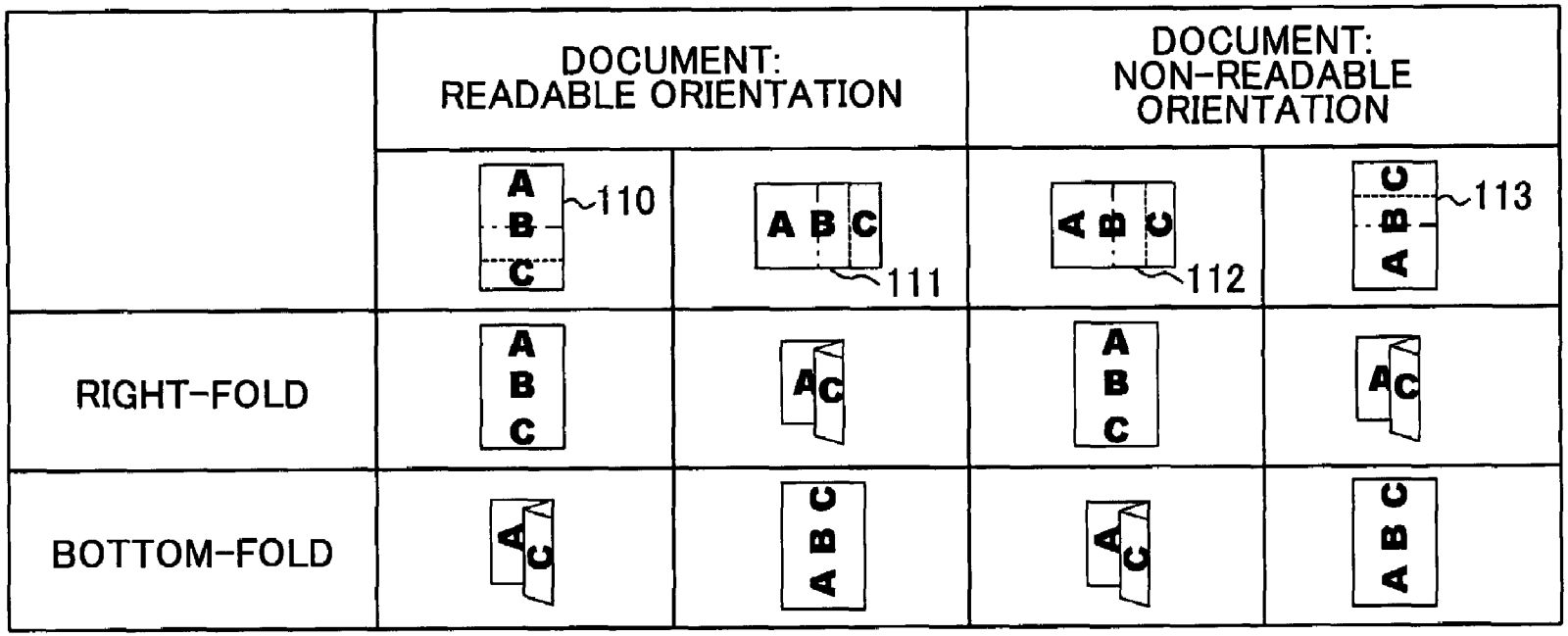
FIG. 5 is a diagram for explaining a Z-fold.

FIG. 5 is a diagram for explaining the Z-fold. FIG. 5 shows the correspondence to the readable orientation and non-readable orientation of the documents in relation to the right-fold and bottom-fold, in the form of a table. The first column of the table shows the readable orientation of the document, and the second column of the table shows the non-readable orientation of the document. The unlabelled first row of the table shows documents 110 and 111 in the readable orientation and documents 112 and 113 in the non-readable orientation. The second row of the table shows the right-fold of the recording media corresponding to the documents 110, 111, 112 and 113. The third row of the table shows the bottom-fold of the recording media corresponding to the documents 110, 111, 112 and 113. In other words, the first row of the table shown in FIG. 5 shows the documents 110 through 113, and the second and third rows of the table show the recording media on which the images of the documents 110 through 113 are formed by the copying process.

In FIG. 5, it is assumed for the sake of convenience that the size of the document and the size of the recording medium are the same. Further, in FIG. 5 and FIGS. 8, 9, 13 and 17 which will be describe later, it is assumed for the sake of convenience that the documents have "ABC" written thereon.

As may be seen from FIG. 5, the folding of the longer side of the recording medium is permitted, but the folding of the shorter side of the recording medium is prohibited. The recording medium is not folded when the folding is prohibited. Hence, the longer side of the corresponding recording medium is folded when the bottom-fold is specified with respect to the document 110 or 112, and the longer side of the corresponding recording medium is folded when the right-fold is specified with respect to the document 111 or 113. On the other hand, the shorter side of the corresponding recording medium is not folded (that is, the recording medium is not folded) when the bottom-fold is specified with respect to the document 111 or 113, and the shorter side of the corresponding recording medium is not folded (that is, the recording medium is not folded) when the right-fold is specified with respect to the document 110 or 112.

Figure 6:
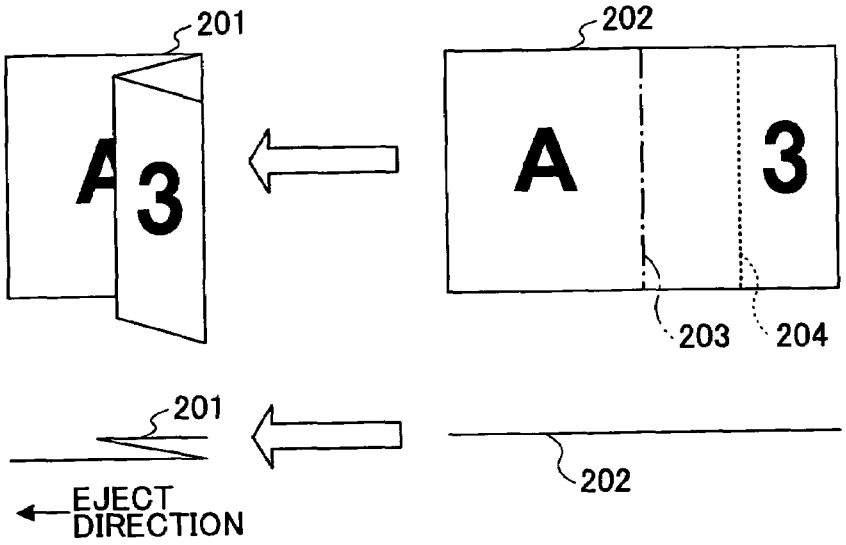
FIG. 6 is a diagram for explaining a recording medium subjected to a Z-fold.

The recording medium that is subjected to the Z-fold assumes a size that is ½ that of the document, as described hereunder with reference to FIG. 6. FIG. 6 is a diagram for explaining the recording medium subjected to the Z-fold. FIG. 6 shows a document 202 and a corresponding recording medium 201 on which the image of the document 202 is formed and ejected in an eject direction. An upper portion of FIG. 6 shows a perspective view of the recording medium 201 and a plan view of the document 202, while a lower portion of FIG. 6 shows a side view of the recording medium 201 and the document 202. The recording medium 201 is folded in mutually opposite directions (that is, inwards and outwards in the upper portion of FIG. 6) at positions corresponding to a one-dot chain line 203 and a dotted line 204 on the document 202. The one-dot chain line 203 sections the document 202 into ½ the total document area, and the dotted line 204 sections ½ of the total document area into ½ (that is, ¼ the total document area).

Figure 7:
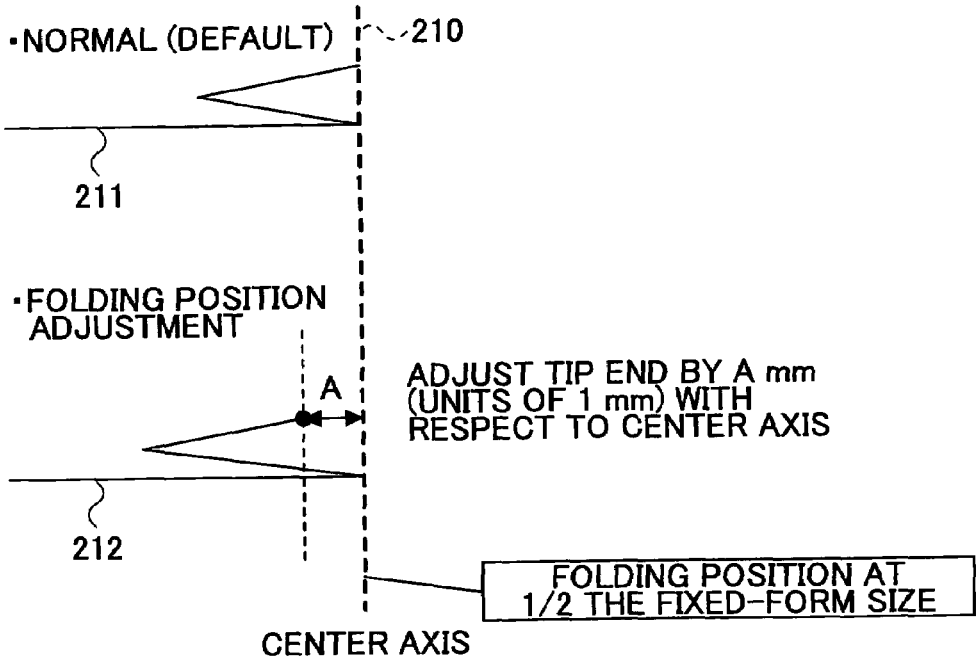
FIG. 7 is a diagram for explaining an adjustment of a folding position.

The positions (corresponding to the lines 203 and 204 on the document 202) where the recording medium 201 is folded may be slightly adjustable, as shown in FIG. 7. FIG. 7 is a diagram for explaining an adjustment of the folding position. FIG. 7 shows a side view of a recording medium 211 which is normally used as a default and a recording medium 212 that is subjected to the folding position adjustment. A center axis 210 indicates the folding position where the recording medium 211 is first folded to section the recording medium 211 into ½ the total recording medium area. The folding position where the recording medium 212 is folded may be adjusted by a distance A mm relative to the center axis 210. For example, the value of the distance A mm may be set to an integer value.

Next, the definition of the terms "vertical" and "horizontal" will be given with referring again to FIG. 3. In general, the "vertical" orientation of the document refers to that of the document 101 shown in FIG. 3, and the "horizontal" orientation of the document refers to that of the document 102 shown in FIG. 3. But in this specification, the vertical and horizontal orientations of the document will be defined in relation to a main scanning direction in which the composite apparatus 1 scans the document. The composite apparatus 1 normally scans the document from the right to left or vice versa, relative to the operator 100 in FIG. 3. Therefore, in this specification, the document 101 is defined as having a "horizontal" orientation relative to the main scanning direction, because the shorter side of the document 101 is parallel to the main scanning direction thereby making the "R" readable in its orientation. Further, in this specification, the document 102 is defined as having a "vertical" orientation relative to the main scanning direction, because the longer side of the document 102 is parallel to the main scanning direction thereby making the "R" non-readable in its orientation.

The Z-fold desired by the operator can be realized on the recording medium by inputting the Z-fold direction (that is, the right-fold or bottom-fold) and the readable orientation from the operation panel 39 shown in FIG. 2. The operation panel 39 notifies the Z-fold direction and the readable orientation that are input by the operator to the ECS 17.

Next, a description will be given of the manner in which the copying process is carried out to form the image of the document on the recording medium, when the Z-fold is to be made while making a media specifying magnification and the documents having mixed sizes coexist. The media specifying magnification refers to an image forming process (copying process) which magnifies the image of the document by a suitable magnification (or zoom) when forming the image on the recording medium having a size that is specified by the operator.

Figure 8:
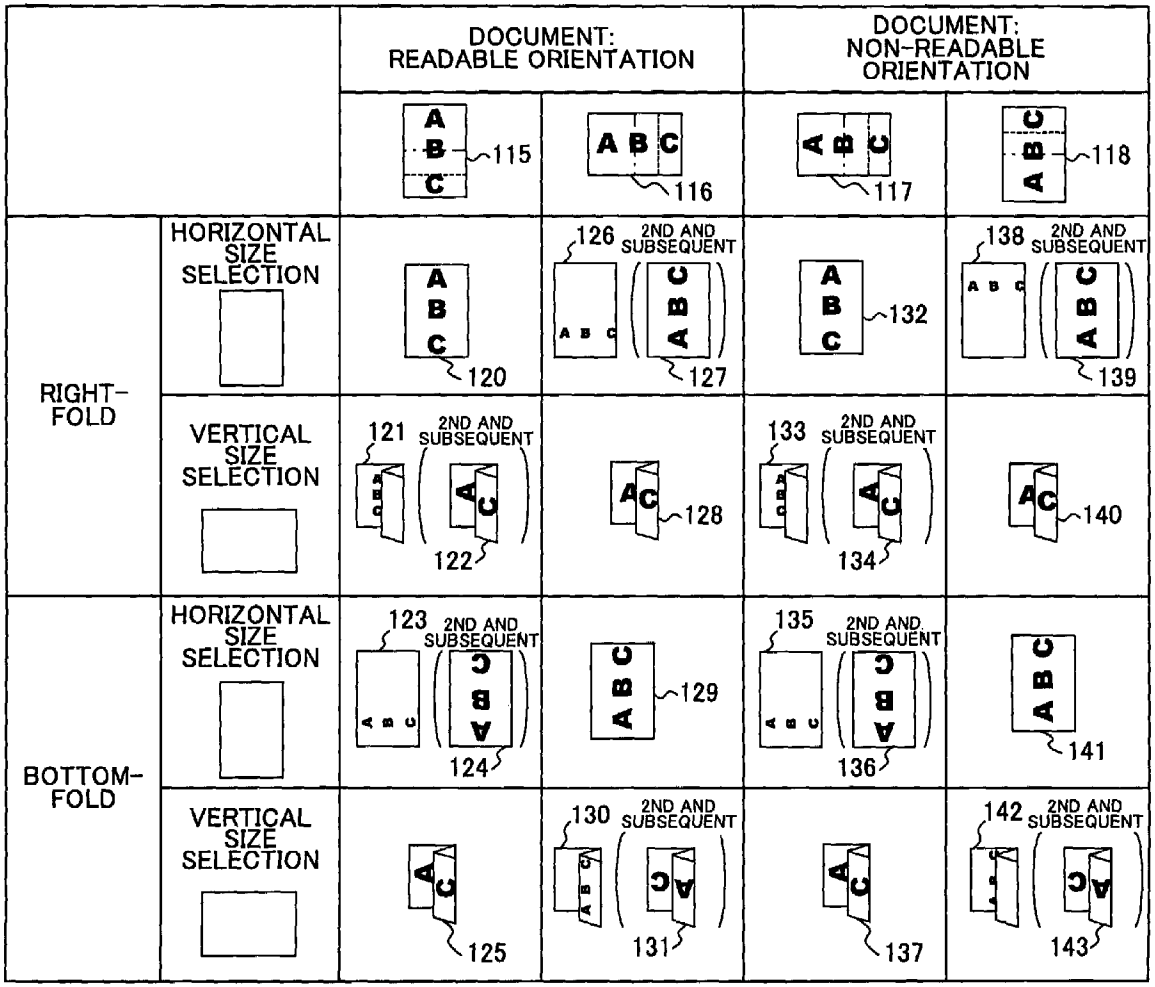
FIG. 8 is a diagram for explaining a media specifying magnification and the Z-fold.

First, a description will be given of the media specifying magnification and the Z-fold, by referring to FIG. 8. FIG. 8 is a diagram for explaining the media specifying magnification and the Z-fold. FIG. 8 shows the correspondence to the readable orientation and non-readable orientation of the documents in relation to the right-fold and bottom-fold, in the form of a table. In FIG. 8, the first column of the table indicates the readable orientation of the document, and the second column of the table indicates the non-readable orientation of the document. Furthermore, the unlabelled first row of the table shows documents 115 and 116 in the readable orientation and documents 117 and 118 in the non-readable orientation. The second row of the table indicates the right-fold for cases where a "horizontal size" is selected and a "vertical size" is selected. The third row of the table indicates the bottom-fold for the cases where the "horizontal size" is selected and the "vertical size" is selected.

The "horizontal size" is selected when the operator wishes to form the image of the document on the recording medium that has the horizontal orientation, and the "vertical size" is selected when the operator wishes to form the image of the document on the recording medium that has the vertical orientation, when carrying out the copying process. In other words, the first row of the table shown in FIG. 8 shows the documents 115 through 118, and the second and third rows of the table show recording media 120 through 143 on which the images of the documents 115 through 118 are formed by the copying process employing the media specifying magnification. In FIG. 8, it is assumed for the sake of convenience that the size of the document and the size of the recording medium are the same. The actual copying process will be described later.

When the right-fold and the horizontal size are selected for the copying process employing the media specifying magnification with respect to the readable document 115 in the horizontal orientation, the recording medium 120 in the horizontal orientation is formed with the document image with a magnification 1 (that is, no reduction or enlargement) and ejected from the composite apparatus 1 as it is without the right-fold. When the right-fold and the vertical size are selected for the copying process with respect to the readable document 115, the recording medium 121 in the vertical orientation is formed with the document image with a magnification less than 1 (that is, reduction) so as to have a right margin (blank space) and ejected with the right-fold for the first copy, and the recording medium 122 in the vertical orientation is formed with the document image with a magnification 1 and a −90 degree image rotation and ejected with the right-fold for the second and subsequent copies. For the sake of convenience, the image rotation in a clockwise direction is regarded as a rotation in a positive angular direction, and the image rotation in an anticlockwise direction is regarded as a rotation in a negative angular direction.

When the right-fold and the horizontal size are selected for the copying process employing the media specifying magnification with respect to the readable document 116 in the vertical orientation, the recording medium 126 in the horizontal orientation is formed with the document image with a magnification less than 1 so as to have a top margin (blank space) and ejected from the composite apparatus 1 without the right-fold for the first copy, and the recording medium 127 in the horizontal orientation is formed with the document image with a magnification 1 and a −90 degree image rotation and ejected without the right-fold for the second subsequent copies. When the right-fold and the vertical size are selected for the copying process with respect to the readable document 116, the recording medium 128 in the vertical orientation is formed with the document image with a magnification 1 and ejected with the right-fold.

When the bottom-fold and the horizontal size are selected for the copying process employing the media specifying magnification with respect to the readable document 115 in the horizontal orientation, the recording medium 123 in the horizontal orientation is formed with the document image with a magnification less than 1 and a −90 degree image rotation so as to have a top margin and ejected from the composite apparatus 1 without the bottom-fold for the first copy, and the recording medium 124 in the horizontal orientation is formed with the document image with a magnification 1 and a −180 degree image rotation and ejected without the bottom fold for the second and subsequent copies. When the bottom-fold and the vertical size are selected for the copying process with respect to the readable document 115, the recording medium 125 in the vertical orientation is formed with the document image with a magnification 1 and a −90 degree image rotation and ejected with the bottom-fold.

When the bottom-fold and the horizontal size are selected for the copying process employing the media specifying magnification with respect to the readable document 116 in the vertical orientation, the recording medium 129 in the horizontal orientation is formed with the document image with a magnification 1 and a −90 degree image rotation and ejected from the composite apparatus 1 without the bottom-fold. When the bottom-fold and the vertical size are selected for the copying process with respect to the readable document 116, the recording medium 130 in the vertical orientation is formed with the document image with a magnification less than 1 and a −90 degree image rotation so as to have a left margin (blank space) and ejected with the bottom-fold for the first copy, and the recording medium 131 in the vertical orientation is formed with the document image with a magnification 1 and a −180 degree image rotation and ejected with the bottom-fold for the second subsequent copies.

On the other hand, when the right-fold and the horizontal size are selected for the copying process employing the media specifying magnification with respect to the non-readable document 117 in the vertical orientation, the recording medium 132 in the horizontal orientation is formed with the document image with a magnification 1 and a 90 degree image rotation and ejected from the composite apparatus 1 without the right-fold. When the right-fold and the vertical size are selected for the copying process with respect to the non-readable document 117, the recording medium 133 in the vertical orientation is formed with the document image with a magnification less than 1 and a 90 degree image rotation so as to have a right margin and ejected with the right-fold for the first copy, and the recording medium 134 in the vertical orientation is formed with the document image with a magnification 1 and ejected with the right-fold for the second and subsequent copies.

When the right-fold and the horizontal size are selected for the copying process employing the media specifying magnification with respect to the non-readable document 118 in the horizontal orientation, the recording medium 138 in the horizontal orientation is formed with the document image with a magnification less than 1 and a 90 degree image rotation so as to have a bottom margin (blank space) and ejected from the composite apparatus 1 without the right-fold for the first copy, and the recording medium 139 in the horizontal orientation is formed with the document image with a magnification 1 and ejected without the right-fold for the second subsequent copies. When the right-fold and the vertical size are selected for the copying process with respect to the non-readable document 118, the recording medium 140 in the vertical orientation is formed with the document image with a magnification 1 and a −90 image rotation and ejected with the right-fold.

When the bottom-fold and the horizontal size are selected for the copying process employing the media specifying magnification with respect to the non-readable document 117 in the vertical orientation, the recording medium 135 in the horizontal orientation is formed with the document image with a magnification less than 1 so as to have a top margin and ejected from the composite apparatus 1 without the bottom-fold for the first copy, and the recording medium 136 in the horizontal orientation is formed with the document image with a magnification 1 and a −90 degree image rotation and ejected without the bottom fold for the second and subsequent copies. When the bottom-fold and the vertical size are selected for the copying process with respect to the non-readable document 117, the recording medium 137 in the vertical orientation is formed with the document image with a magnification 1 and ejected with the bottom-fold.

When the bottom-fold and the horizontal size are selected for the copying process employing the media specifying magnification with respect to the non-readable document 118 in the horizontal orientation, the recording medium 141 in the horizontal orientation is formed with the document image with a magnification 1 and ejected from the composite apparatus 1 without the bottom-fold. When the bottom-fold and the vertical size are selected for the copying process with respect to the non-readable document 118, the recording medium 142 in the vertical orientation is formed with the document image with a magnification less than 1 so as to have a right margin and ejected with the bottom-fold for the first copy, and the recording medium 143 in the vertical orientation is formed with the document image with a magnification 1 and a −90 degree image rotation and ejected with the bottom-fold for the second subsequent copies.

Of course, the document image subjected to the magnification and/or the image rotation is formed on the recording medium by the plotter 26, and the recording medium is thereafter subjected to the Z-fold by the folding mechanism included in the other hardware resources 24 if necessary.

Figure 9:
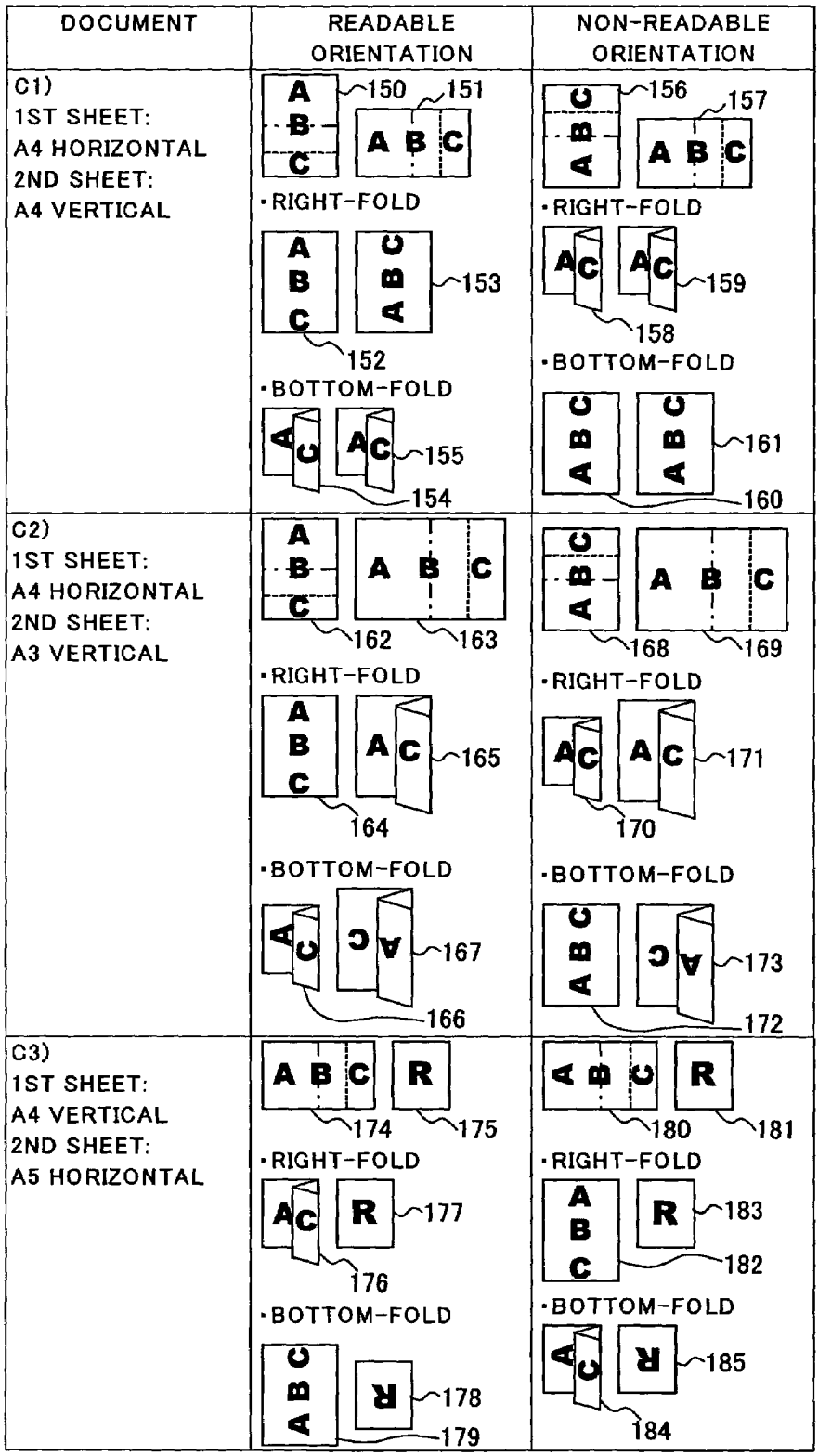
FIG. 9 is a diagram for explaining a Z-fold of documents having mixed sizes.

Next, a description will be given of the Z-fold for the case where documents having mixed (or different) sizes coexist, by referring to FIG. 9. FIG. 8 is a diagram for explaining the media specifying magnification and the Z-fold. FIG. 9 is a diagram for explaining the Z-fold of documents having mixed sizes, in the form of a table. In FIG. 9, the first column of the table indicates the combination of 2 successive documents, the second column indicates the readable orientation of the documents, and the third column of the table indicates the non-readable orientation of the documents. Furthermore, the first row of the table shows a case C1) where a first document has the A4-size with the horizontal orientation and a second document has the A4-size with the vertical orientation. The second row of the table shows a case C2) where a first document has the A4-size with the horizontal orientation and a second document has the A3-size with the vertical orientation. In addition, the third row of the table row of the table shows a case C3) where a first document has the A4-size with the vertical orientation and a second document has the A5-size with the horizontal orientation. In each of the first through third rows, the upper portion shows the documents, and the middle and lower portions show the corresponding recording media formed with the images of the documents.

Case C1):

When the right-fold is selected for the copying process with respect to a readable document 150 in the horizontal orientation and a readable document 151 in the vertical orientation, a recording medium 152 in the horizontal orientation is formed with the document image of the readable document 150 and ejected from the composite apparatus 1 without the right-fold, and a recording medium 153 in the horizontal orientation is formed with the document image of the readable document 151 with a −90 degree image rotation and ejected without the right-fold in succession to the recording medium 152. When the bottom-fold is selected for the copying process with respect to the readable documents 150 and 151, a recording medium 154 in the vertical orientation is formed with the document image of the readable document 150 with a −90 degree image rotation and ejected with the bottom-fold, and a recording medium 155 in the vertical orientation is formed with the document image of the readable document 151 and ejected with the bottom-fold in succession to the recording medium 155.

When the right-fold is selected for the copying process with respect to a non-readable document 156 in the horizontal orientation and a non-readable document 157 in the vertical orientation, a recording medium 158 in the vertical orientation is formed with the document image of the non-readable document 156 with a 90 degree image rotation and ejected from the composite apparatus 1 with the right-fold, and a recording medium 159 in the vertical orientation is formed with the document image of the non-readable document 157 and ejected with the right-fold in succession to the recording medium 158. When the bottom-fold is selected for the copying process with respect to the non-readable documents 156 and 157, a recording medium 160 in the horizontal orientation is formed with the document image of the non-readable document 156 and ejected without the bottom-fold, and a recording medium 161 in the horizontal orientation is formed with the document image of the non-readable document 157 with a −90 degree image rotation and ejected without the bottom-fold in succession to the recording medium 160.

Case C2):

When the right-fold is selected for the copying process with respect to a readable document 162 in the horizontal orientation and a readable document 163 in the vertical orientation, a recording medium 164 in the horizontal orientation is formed with the document image of the readable document 162 and ejected from the composite apparatus 1 without the right-fold, and a recording medium 165 in the vertical orientation is formed with the document image of the readable document 163 and ejected with the right-fold in succession to the recording medium 165. When the bottom-fold is selected for the copying process with respect to the readable documents 162 and 163, a recording medium 166 in the vertical orientation is formed with the document image of the readable document 162 with a −90 degree image rotation and ejected with the bottom-fold, and a recording medium 167 in the vertical orientation is formed with the document image of the readable document 163 and ejected with the bottom-fold in succession to the recording medium 166.

When the right-fold is selected for the copying process with respect to a non-readable document 168 in the horizontal orientation and a non-readable document 169 in the vertical orientation, a recording medium 170 in the vertical orientation is formed with the document image of the non-readable document 168 with a 90 degree image rotation and ejected from the composite apparatus 1 with the right-fold, and a recording medium 171 in the vertical orientation is formed with the document image of the non-readable document 169 and ejected with the right-fold in succession to the recording medium 170. When the bottom-fold is selected for the copying process with respect to the non-readable documents 168 and 169, a recording medium 172 in the horizontal orientation is formed with the document image of the non-readable document 168 and ejected without the bottom-fold, and a recording medium 173 in the vertical orientation is formed with the document image of the non-readable document 169 with a 180 degree image rotation and ejected with the bottom-fold in succession to the recording medium 172.

Case C3):

When the right-fold is selected for the copying process with respect to a readable document 174 in the vertical orientation and a readable document 175 in the horizontal orientation, a recording medium 176 in the vertical orientation is formed with the document image of the readable document 174 and ejected from the composite apparatus 1 with the right-fold, and a recording medium 177 in the horizontal orientation is formed with the document image of the readable document 175 and ejected without the right-fold in succession to the recording medium 176. When the bottom-fold is selected for the copying process with respect to the readable documents 174 and 175, a recording medium 178 in the horizontal orientation is formed with the document image of the readable document 174 with a −90 degree image rotation and ejected without the bottom-fold, and a recording medium 179 in the horizontal orientation is formed with the document image of the readable document 175 with a 180 degree image rotation and ejected without the bottom-fold in succession to the recording medium 178.

When the right-fold is selected for the copying process with respect to a non-readable document 180 in the vertical orientation and a non-readable document 181 in the horizontal orientation, a recording medium 182 in the horizontal orientation is formed with the document image of the non-readable document 180 with a 90 degree image rotation and ejected from the composite apparatus 1 without the right-fold, and a recording medium 183 in the horizontal orientation is formed with the document image of the non-readable document 181 and ejected without the right-fold in succession to the recording medium 182. When the bottom-fold is selected for the copying process with respect to the non-readable documents 180 and 181, a recording medium 184 in the vertical orientation is formed with the document image of the non-readable document 180 and ejected without the bottom-fold, and a recording medium 185 in the horizontal orientation is formed with the document image of the non-readable document 181 with a 180 degree image rotation and ejected without the bottom-fold in succession to the recording medium 184.

Next, a description will be given of the processes that are carried out when the Z-fold is to be made while making the media specifying magnification and when the documents having mixed sizes coexist, with reference to flow charts. The processes of the flow charts described hereunder are carried out by the ECS 17 shown in FIG. 1. Although the data of the document image are actually subjected to the magnification and/or image rotation, the following description also simply refers to such as the magnification and/or image rotation of the document.

Figure 10:
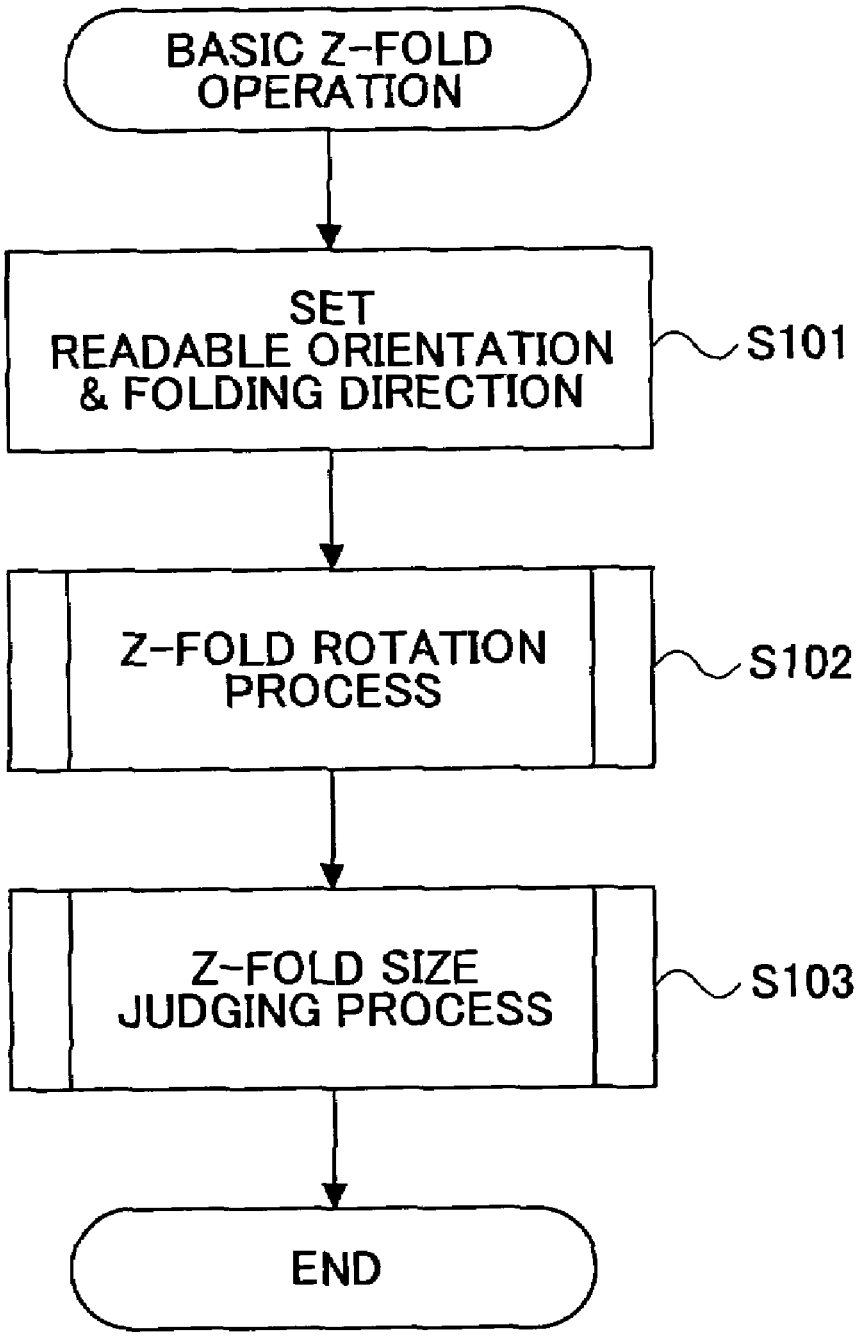
FIG. 10 is a flow chart for explaining a basic Z-fold operation of a composite apparatus.

FIG. 10 is a flow chart for explaining a basic Z-fold operation of the composite apparatus 1. In FIG. 10, a step S101 receives a readable orientation of the document and a folding direction of the recording medium that are input by the operator from the operation panel 39, so as to carry out a readable orientation setting process and a folding direction setting process. A step S102 carries out a Z-fold rotation process. The Z-fold rotation process carries out an image rotation which electronically rotates the data of the scanned document depending on the Z-fold, and forms the image or the rotated image on the recording medium. A step S103 carries out a Z-fold size judging process, and the process ends. The Z-fold size judging process judges whether or not the recording medium has a size which enables the Z-fold. The Z-fold cannot be made regardless of the size of the recording medium. In this embodiment, it is regarded that the Z-fold can be made with respect to the recording media having the A3-size in the vertical orientation, B4-size in the vertical orientation, A4-size in the vertical orientation, DLT-size in the vertical orientation, the LG-size in the vertical orientation, and the LT-size in the vertical orientation.

Figure 11:
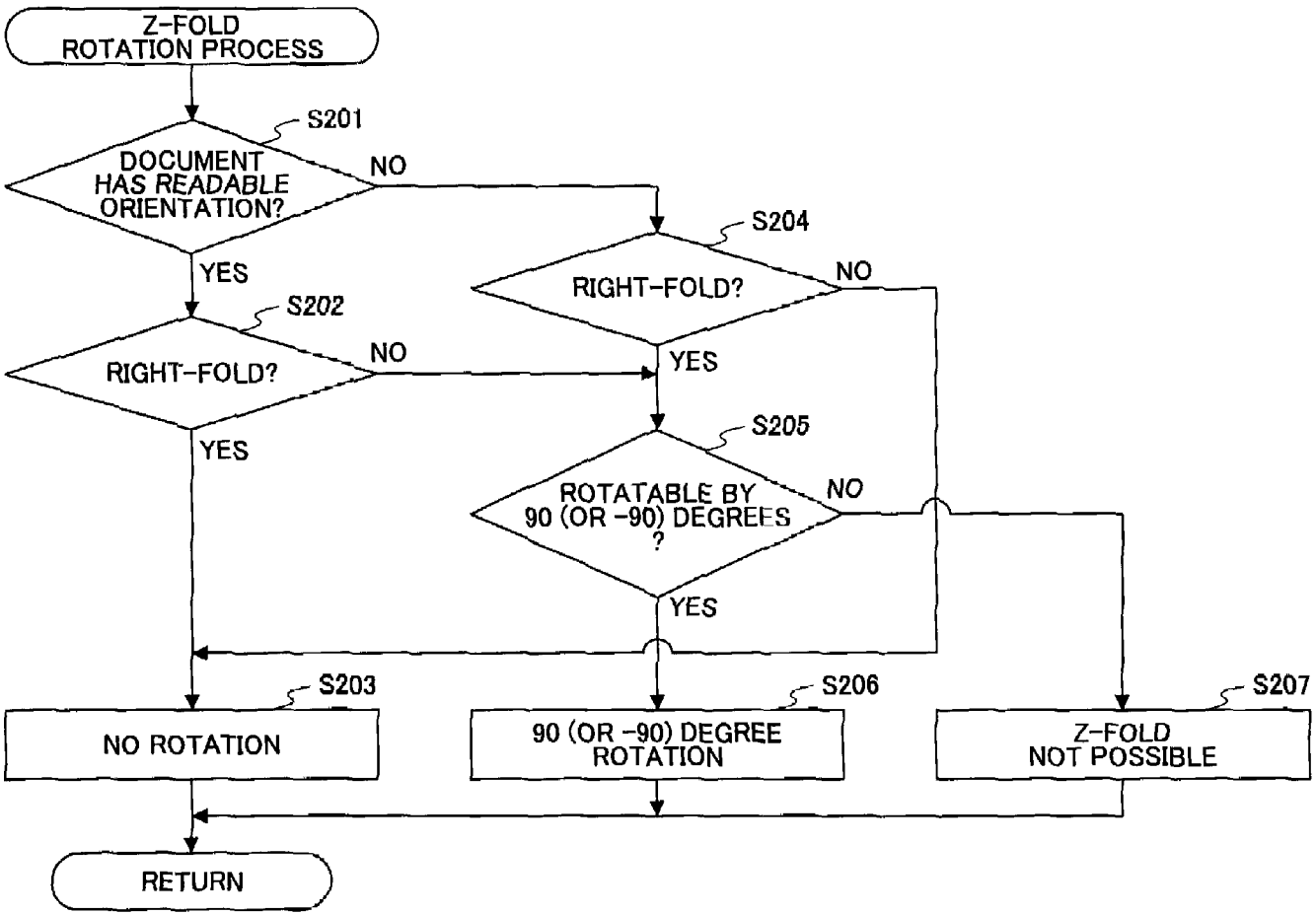
FIG. 11 is a flow chart for explaining a Z-fold rotation process.

Next, a more detailed description will be given of the Z-fold rotation process carried out in the step S102 shown in FIG. 10, by referring to FIG. 11. FIG. 11 is a flow chart for explaining the Z-fold rotation process.

In FIG. 11, a step S201 carries out an orientation judging process to judge whether or not the document has the readable orientation. If the judgement result in the step S201 is YES, a step S202 judges whether or not the right-fold is selected and required, based on the information of the table shown in FIG. 8 or 9. The information of the table shown in FIG. 8 or 9 may be stored in a suitable memory or storage part of the composite apparatus 1, such as the memories 32 and 37 and the HDD 38. If the judgement result in the step S202 is YES, a step S203 determines that no image rotation is required, based on the information of the table shown in FIG. 8 or 9, and forms the image as it is on the recording medium, and the process returns to the step S103 shown in FIG. 10.

If the document has the non-readable orientation and the judgement result in the step S201 is NO, a step S204 carries out a right-fold judging process to judge whether or not the right-fold is selected and required, based on the information of the table shown in FIG. 8 or 9. The process advances to the step S203 if the judgement result in the step S204 is NO. If the judgement result in the step S202 is NO or the judgement result in the step S204 is YES, a step S205 judges whether or not the image rotation (for example, −90, 90 or 180 degree image rotation) required based on the information of the table shown in FIG. 8 or 9 is possible.

If the judgement result in the step S205 is YES, a step S206 carries out the required image rotation, and forms the rotated image on the recording medium, and the process returns to the step S103 shown in FIG. 10. On the other hand, if the judgement result in the step S205 is ON, a step S207 judges that the Z-fold is not possible in the required folding direction, and forms the image as it is on the recording medium, and the process returns to the step S103 shown in FIG. 10. The steps S203, S206 and S207 carry out an image rotation determining process that determines the image rotation (rotation angle) with respect to the document.

Figure 12:
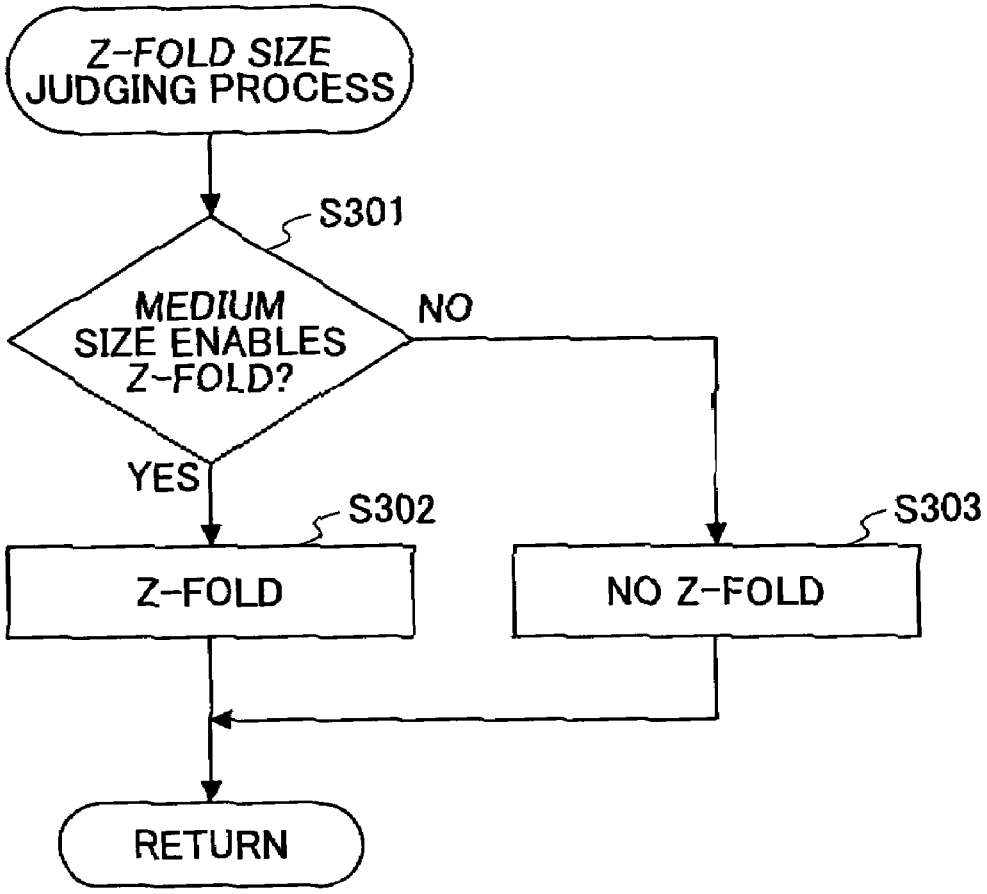
FIG. 12 is a flow chart for explaining a Z-fold size judging process.

Next, a more detailed description will be given of the Z-fold size judging process carried out in the step S103 shown in FIG. 10, by referring to FIG. 12. FIG. 12 is a flow chart for explaining the Z-fold size judging process.

In FIG. 12, a step S301 carries out a judging process to judge whether or not the recording medium has a size which enables the Z-fold, based on the information of the table shown in FIG. 8 or 9. If the decision result in the step S301 is YES, a step S302 subjects the recording medium to the Z-fold before ejecting the recording medium from the composite apparatus 1, based on the information of the table shown in FIG. 8 or 9, and the process ends. On the other hand, if the decision result in the step S301 is NO, a step S303 does not subject the recording medium to the Z-fold when ejecting the recording medium from the composite apparatus 1, based on the information of the table shown in FIG. 8 or 9.

The Z-fold of the recording medium may be realized by the folding mechanism having a known structure for folding the recording medium. Accordingly, a description and illustration of the folding mechanism itself will be omitted. This folding mechanism within the other hardware resources 24 may also form a part of the Z-fold part or means described above.

Figure 13:
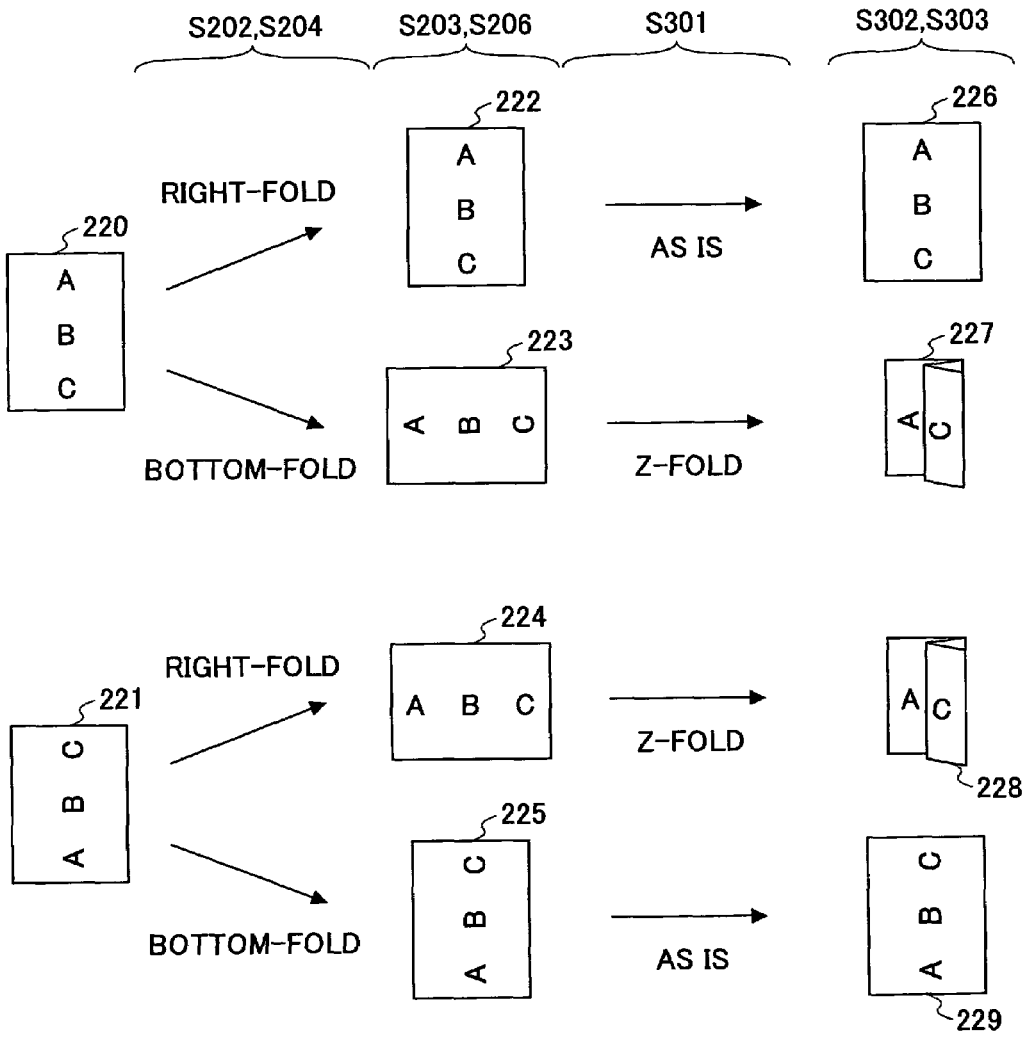
FIG. 13 is a diagram for explaining a copying process employing the basic Z-fold operation.

FIG. 13 is a diagram for explaining the copying process employing the basic Z-fold operation described above. FIG. 13 shows documents 220 and 221, document data 222 and 223 of the document 220 and document data 224 and 225 of the document 221 that are processed by the steps S202 and S204 and the steps S203 and S206 shown in FIG. 11 and the step S301 shown in FIG. 12, in relation to recording media 226, 227, 228 and 229 that are ejected from the composite apparatus 1 by the steps S302 and S303 shown in FIG. 12.

The document data of the document 220 in the readable orientation is processed differently depending on whether or not the recording medium on which the document image is formed is to be subjected to the right-fold by the judgement made in the step S202. In the case of the right-fold, the document data of the document 220 is processed as it is (that is, no image rotation is made) as the document data 222 that is formed on the recording medium in the step S203, and if the step S301 judges that the recording medium 226 has a size that does not enable the Z-fold, the step S303 ejects the recording medium 226 without the Z-fold.

In the case of the bottom-fold, the document data of the document 220 is processed into the rotated document data 223 that is formed on the recording medium in the step S206, and if the step S301 judges that the recording medium 227 has a size that enables the Z-fold, the step S302 ejects the recording medium 227 with the Z-fold.

The document data of the document 221 in the non-readable orientation is processed differently depending on whether or not the recording medium on which the document image is formed is to be subjected to the right-fold by the judgement made in the step S204. In the case of the right-fold, the document data of the document 221 is processed into the rotated document data 224 that is formed on the recording medium in the step S206, and if the step S301 judges that the recording medium 228 has a size that enables the Z-fold, the step S302 ejects the recording medium 228 with the Z-fold.

In the case of the bottom-fold, the document data of the document 221 is processed as it is as the document data 225 that is formed on the recording medium in the step S203, and if the step S301 judges that the recording medium 229 has a size that does not enable the Z-fold, the step S303 ejects the recording medium 229 without the Z-fold.

Figure 14:
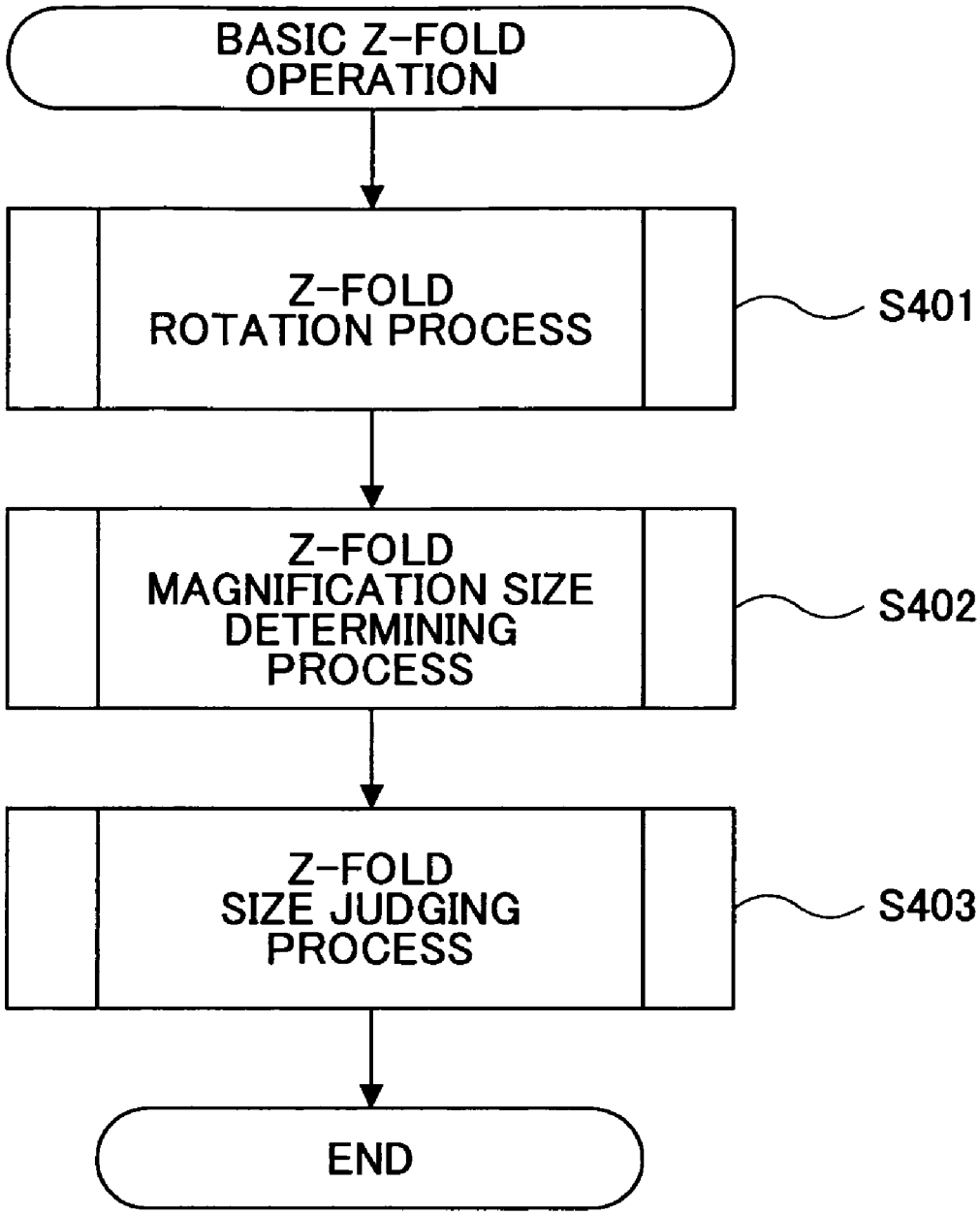
FIG. 14 is a flow chart for explaining a basic Z-fold operation of the composite apparatus when making a media specifying magnification.

Next, a description will be given of a basic Z-fold operation of the composite apparatus 1 when making the media specifying magnification, with reference to FIG. 14. FIG. 14 is a flow chart for explaining the basic Z-fold operation of the composite apparatus 1 when making the media specifying magnification.

In FIG. 14, it is assumed for the sake of convenience that the readable orientation of the document and the folding direction of the recording medium have already been input by the operator. A step S401 carries out the Z-fold rotation process corresponding to that of the step S101 shown in FIG. 10 described above. A step S402 carries out a Z-fold magnification size determining process. The step S403 carries out the Z-fold size judging process corresponding to that of the step S102 shown in FIG. 10.

Figure 15:
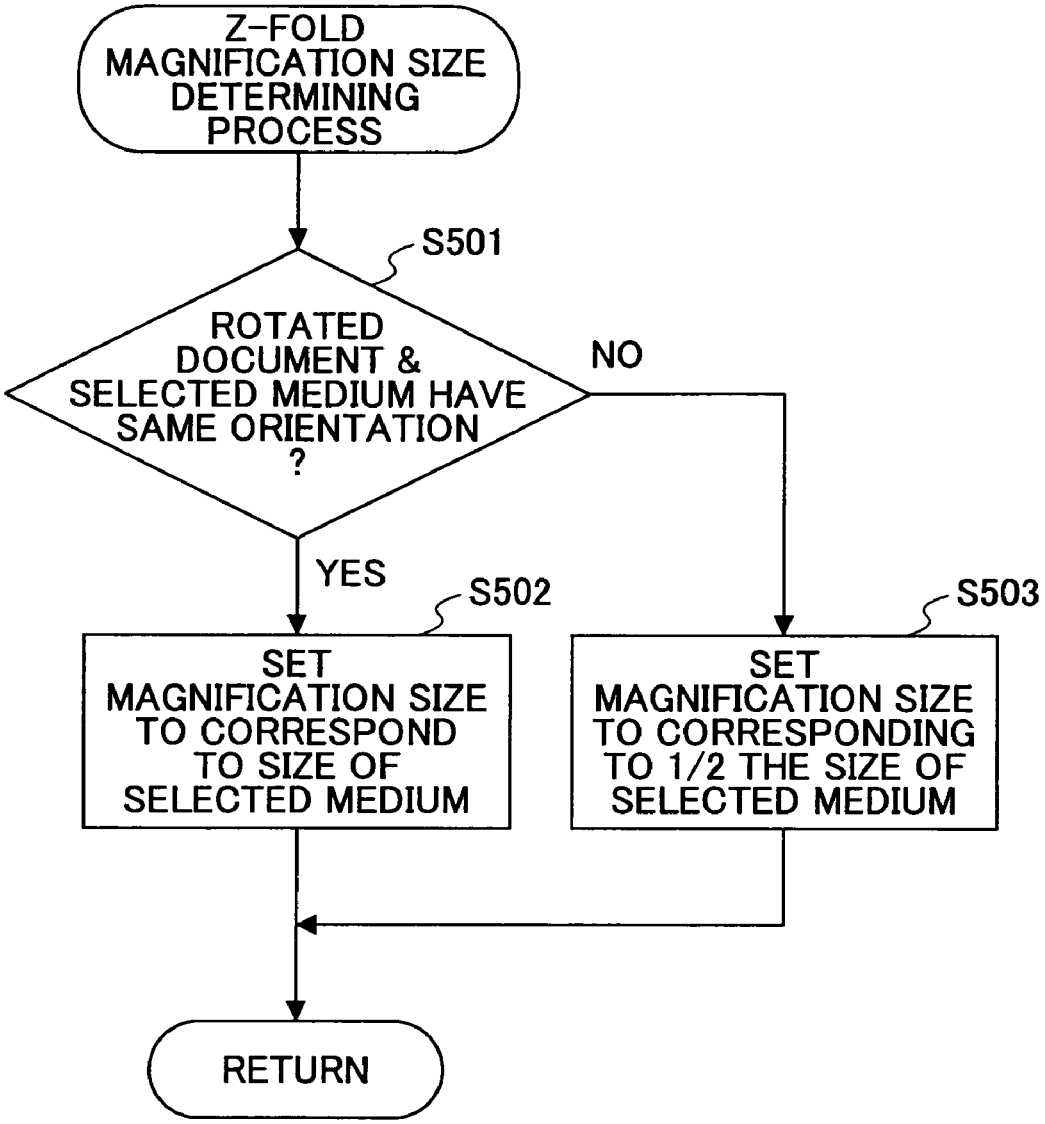
FIG. 15 is a flow chart for explaining a Z-fold magnification size determining process.

FIG. 15 is a flow chart for explaining the Z-fold magnification size determining process. In FIG. 15, a step S501 carries out a direction judging process to judge whether or not the direction (or orientation) of the document after the image rotation is the same as the direction (or orientation) of the selected recording medium. If the judgement result in the step S501 is YES, a step S502 carries out a magnification process to set the magnification size to a size corresponding to the size of the selected recording medium, and the process returns to the step S403 shown in FIG. 14. For example, the step S502 sets the magnification to 1 if the document and the recording medium have the same size. On the other hand, if the judgement result in the step S501 is NO, a step S503 carries out a magnification process to set the magnification size to a size corresponding to ½ the size of the selected recording medium, and the process returns to the step S403 shown in FIG. 14. For example, the step S503 sets the magnification to ½ if the document and the recording medium have the same size.

Figure 16:
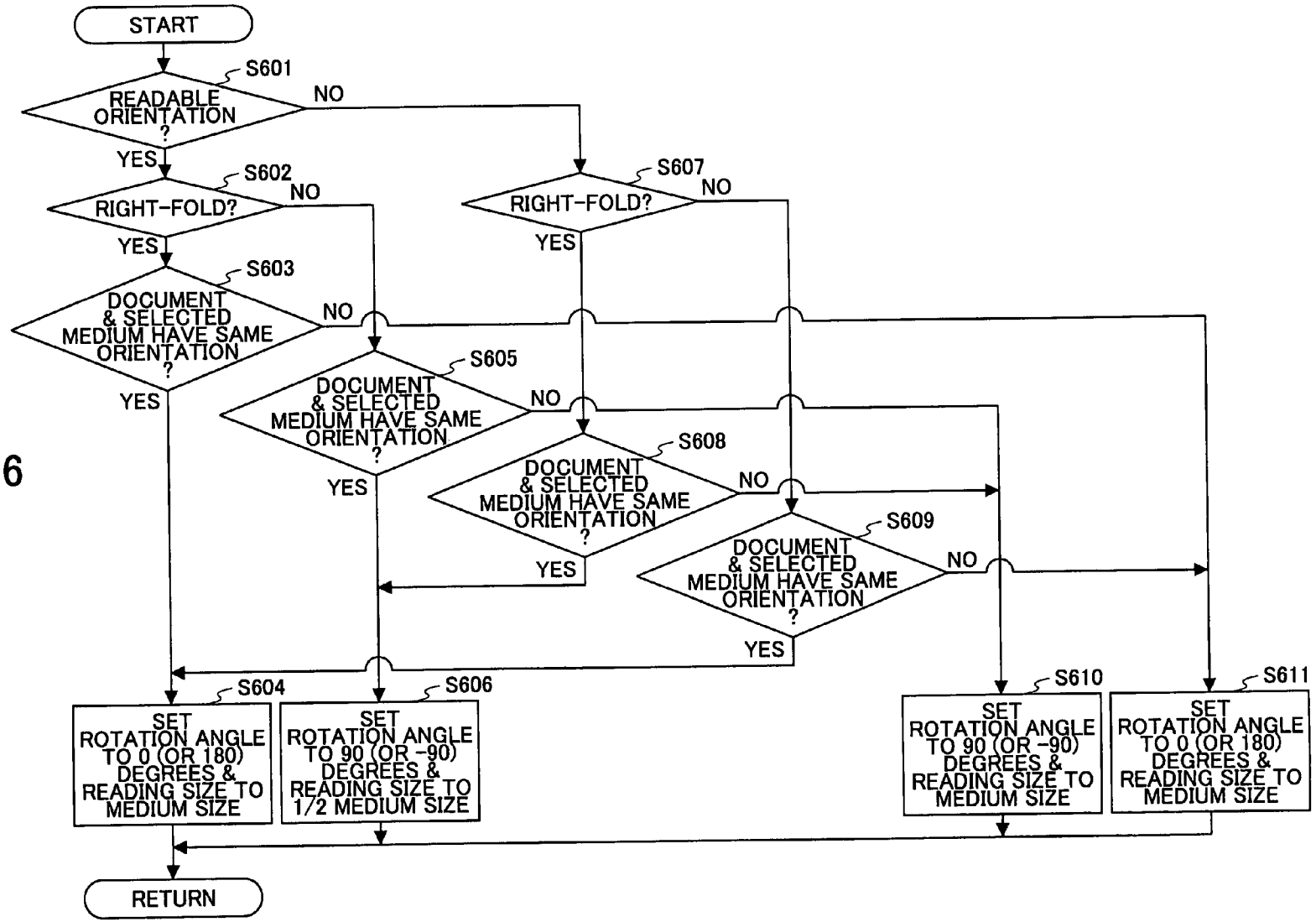
FIG. 16 is a flow chart for explaining the media specifying magnification process.

FIG. 16 is a flow chart for explaining the media specifying magnification process shown in FIGS. 14 and 15 in more detail.

In FIG. 16, a step S601 judges whether or not the document has the readable orientation. If the judgement result in the step S601 is YES, a step S602 judges whether or not the right-fold is selected. If the judgement result in the step S602 is YES, a step S603 judges whether or not the document and the selected recording medium have the same direction (or orientation). If the judgement result in the step S603 is YES, a step S604 sets the image rotation to 0 or 180 degrees and sets the magnification size (reading size) to the size corresponding to the size of the selected recording medium, based on the information of the table shown in FIG. 8 or 9, and the process ends.

If the judgement result in the step S603 is NO, a step S611 sets the image rotation to 0 or 180 degrees and sets the magnification size (reading size) to the size corresponding to ½ the size of the selected recording medium, based on the information of the table shown in FIG. 8 or 9, and the process ends.

If the judgement result in the step S602 is NO, a step S605 judges whether or not the document and the selected recording medium have the same direction (or orientation). If the judgement result in the step S605 is YES, a step S606 sets the image rotation to 90 or −90 (or 270) degrees and sets the magnification size (reading size) to ½ the size corresponding to the size of the selected recording medium, based on the information of the table shown in FIG. 8 or 9, and the process ends.

If the judgement result in the step S605 is NO, a step S610 sets the image rotation to 90 or −90 (or 270) degrees and sets the magnification size (reading size) to the size corresponding to the size of the selected recording medium, based on the information of the table shown in FIG. 8 or 9, and the process ends.

If the judgement result in the step S601 is NO, a step S607 judges whether or not the right-fold is selected. If the judgement result in the step S607 is YES, a step S608 judges whether or not the document and the selected recording medium have the same direction (or orientation). The process advances to the step S606 if the judgement result in the step S608 is YES, and the process advances to the step S610 if the judgement result in the step S608 is NO.

If the judgement result in the step S607 is NO, a step S609 judges whether or not the document and the selected recording medium have the same direction (or orientation). The process advances to the step S604 if the judgement result in the step S609 is YES, and the process advances to the step S611 if the judgement result in the step S609 is NO.

Figure 17:
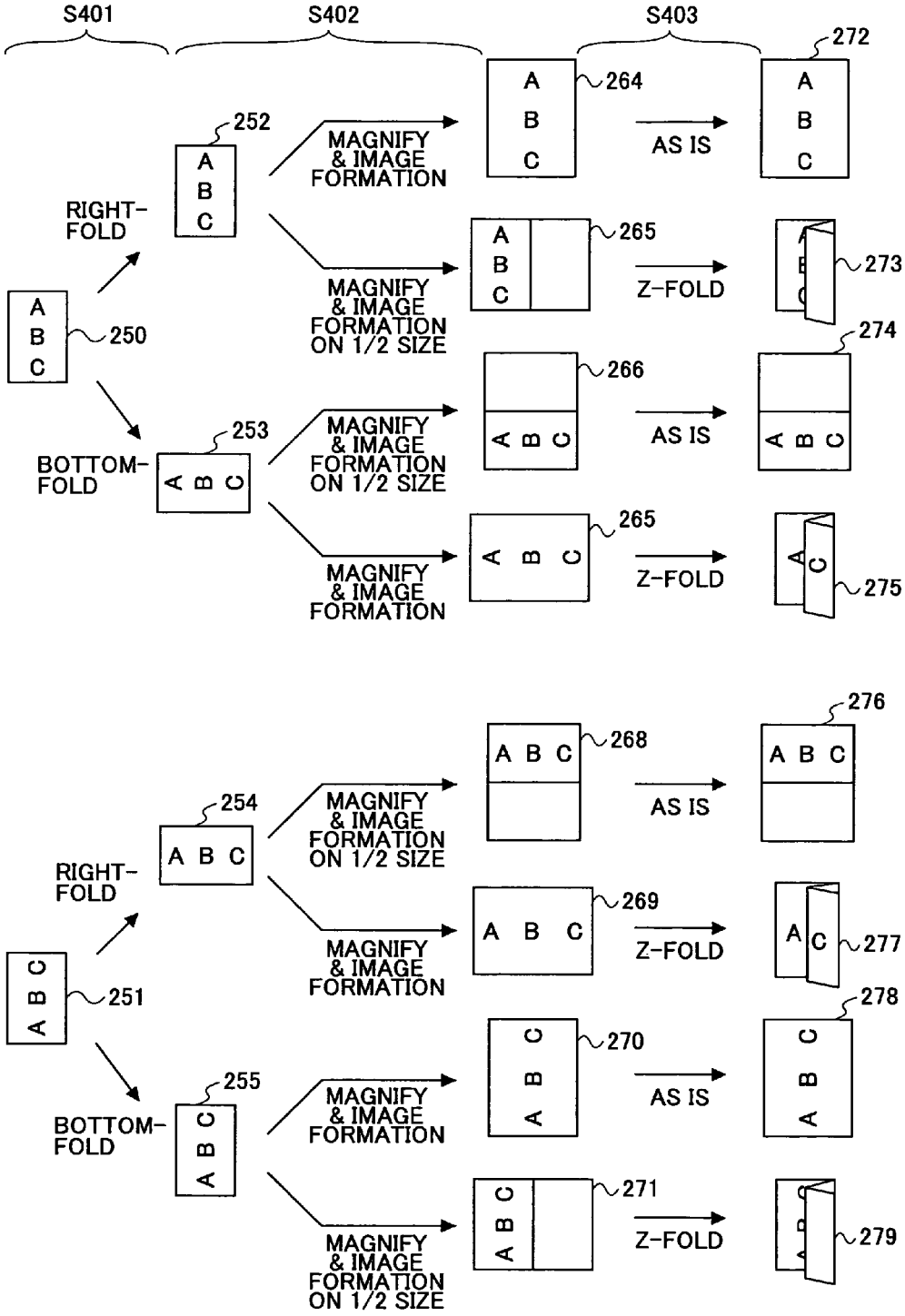
FIG. 17 is a diagram for explaining a copying process employing the media specifying magnification process.

FIG. 17 is a diagram for explaining the copying process employing the media specifying magnification process described above. FIG. 17 shows documents 250 and 251, document data 252, 253, 264, 265, 266 and 267 of the document 250 and document data 254, 255, 268, 269, 270 and 171 of the document 251 that are processed by the step S401 shown in FIG. 14, in relation to recording media 272, 273, 274, 275, 276, 277, 278 and 279 that are ejected from the composite apparatus 1 by the step S403 shown in FIG. 14.

The document data of the document 250 in the readable orientation is processed differently depending on whether or not the recording medium on which the document image is formed is to be subjected to the right-fold by the judgement made in the step S401. In the case of the right-fold, the document data of the document 250 is processed as it is (that is, no image rotation is made) as the document data 252, in the step S402. In addition, the document data 252 is processed with a magnification size corresponding to the size of the selected recording medium as the document data 264 that is formed on the recording medium if the processed document and the selected recording medium have the same orientation, in the step S402. In this case, if the step S403 judges that the recording medium 272 has a size that does not enable the Z-fold, the step S403 ejects the recording medium 272 without the Z-fold. On the other hand, the document data 252 is processed with a magnification size corresponding to ½ the size of the selected recording medium as the document data 265 that is formed on the recording medium if the processed document and the selected recording medium have different orientations, in the step S402. In this latter case, if the step S403 judges that the recording medium 273 has a size that enables the Z-fold, the step S403 ejects the recording medium 273 with the Z-fold.

In the case of the bottom-fold, the document data of the document 250 is processed into the rotated document data 253, in the step S402. In addition, the document data 253 is processed with a magnification size corresponding to ½ the size of the selected recording medium as the document data 266 that is formed on the recording medium if the processed document and the selected recording medium have different orientations, in the step S402. In this case, if the step S403 judges that the recording medium 274 has a size that does not enable the Z-fold, the step S403 ejects the recording medium 274 without the Z-fold. On the other hand, the document data 253 is processed with a magnification size corresponding to the size of the selected recording medium as the document data 267 that is formed on the recording medium if the processed document and the selected recording medium have the same orientation, in the step S402. In this latter case, if the step S403 judges that the recording medium 275 has a size that enables the Z-fold, the step S403 ejects the recording medium 275 with the Z-fold.

The document data of the document 250 in the non-readable orientation is processed differently depending on whether or not the recording medium on which the document image is formed is to be subjected to the right-fold by the judgement made in the step S401. In the case of the right-fold, the document data of the document 251 is processed into the rotated document data 254, in the step S402. In addition, the document data 254 is processed with a magnification size corresponding to ½ the size of the selected recording medium as the document data 268 that is formed on the recording medium if the processed document and the selected recording medium have different orientations, in the step S402. In this case, if the step S403 judges that the recording medium 276 has a size that does not enable the Z-fold, the step S403 ejects the recording medium 276 without the Z-fold. On the other hand, the document data 254 is processed with a magnification size corresponding to the size of the selected recording medium as the document data 269 that is formed on the recording medium if the processed document and the selected recording medium have the same orientation, in the step S402. In this latter case, if the step S403 judges that the recording medium 277 has a size that enables the Z-fold, the step S403 ejects the recording medium 277 with the Z-fold.

In the case of the bottom-fold, the document data of the document 251 is processed as it is (that is, no image rotation is made) as the document data 255, in the step S402. In addition, the document data 255 is processed with a magnification size corresponding to the size of the selected recording medium as the document data 270 that is formed on the recording medium if the processed document and the selected recording medium have the same orientation, in the step S402. In this case, if the step S403 judges that the recording medium 278 has a size that does not enable the Z-fold, the step S403 ejects the recording medium 278 without the Z-fold. On the other hand, the document data 255 is processed with a magnification size corresponding to ½ the size of the selected recording medium as the document data 271 that is formed on the recording medium if the processed document and the selected recording medium have different orientations, in the step S402. In this latter case, if the step S403 judges that the recording medium 279 has a size that enables the Z-fold, the step S403 ejects the recording medium 279 with the Z-fold.

Figure 18:
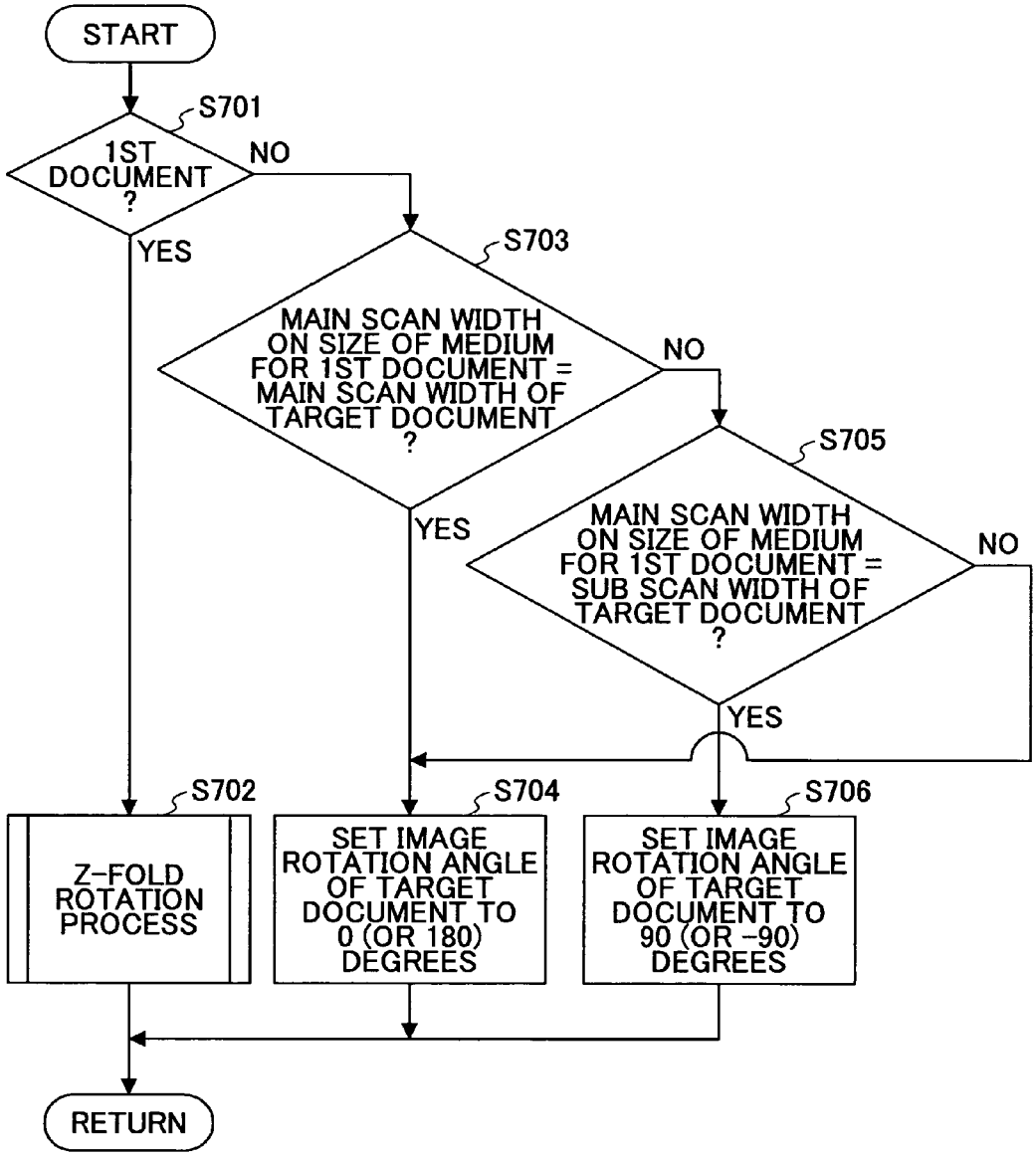
FIG. 18 is a flow chart for explaining a Z-fold process with respect to mixed documents.

Next, a description will be given of the Z-fold process carried out with respect to mixed documents, that is, documents having mixed sizes, by referring to FIG. 18. FIG. 18 is a flow chart for explaining the Z-fold process with respect to the mixed documents.

In FIG. 18, a step S701 judges whether or not a target document (document data) to be subjected to the Z-fold process is the first document. If the judgement result in the step S701 is YES, a step S702 carries out the Z-fold rotation process shown in FIG. 11, and the process ends. On the other hand, if the judgement result in the step S701 is NO, a step S703 judges whether or not the main scanning width on size of the selected recording medium for the first document is equal to the main scanning width of target document (document data) to be subjected to the Z-fold process.

If the judgement result in the step S703 is YES, a step S704 sets the image rotation angle of the target document to 0 (or 180) degrees based on the table shown in FIG. 9, and the process ends. On the other hand, if the judgement result in the step S703 is NO, a step S705 judges whether or not the main scanning width on the size of the selected recording medium for the first document is equal to the sub scanning width of the target document (document data) to be subjected to the Z-fold process. If the judgement result in the step S705 is YES, a step S706 sets the image rotation angle of the target document to 90 (or −90) degrees based on the table shown in FIG. 9, and the process ends. If the judgement result in the step S705 is NO, the process advances to the step S704 described above. Hence, the steps S704 and S706 respectively carry out a process of determining the image rotation angle of the document data.

Figure 19:
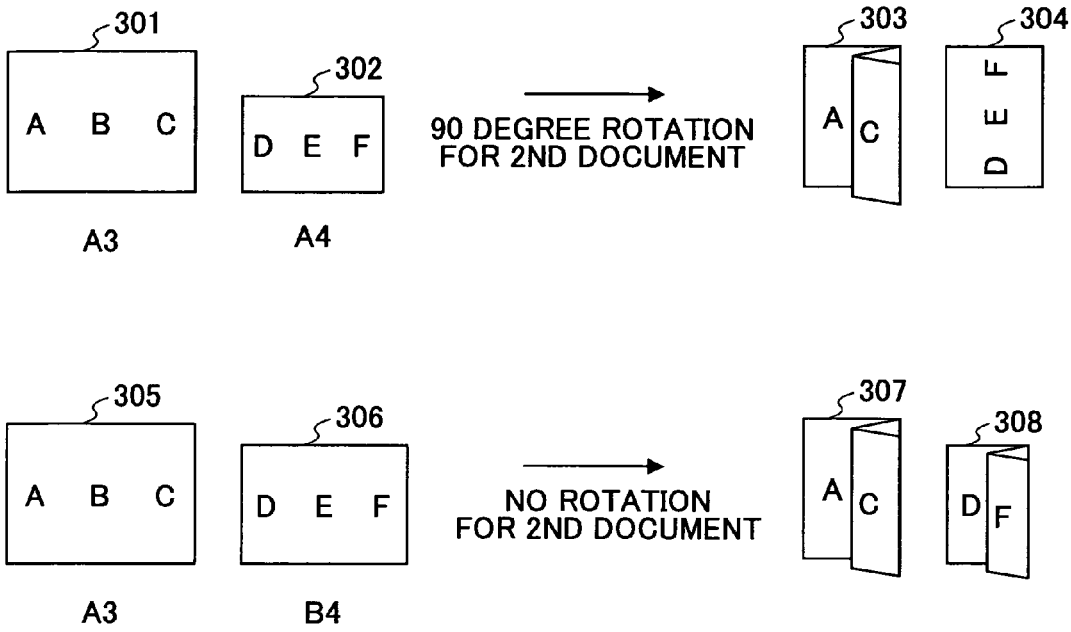
FIG. 19 is a diagram for explaining a copying process when carrying out the Z-fold process with respect to mixed documents.

FIG. 19 is a diagram for explaining the copying process when carrying out the Z-fold process with respect to the mixed documents. An upper portion of FIG. 19 shows a case where a first document 301 has the A3-size and a second document 302 has the A4-size, respectively in the readable orientation (vertical size), and a lower portion of FIG. 19 shows a case where a first document 305 has the A3-size and a second document 306 has the B4-size, respectively in the readable orientation (vertical size).

The main scanning width of the A3-size differs from that of the A4-size, but the main scanning width of the A3-size is equal to the sub scanning width of the A4-size. Accordingly, the image of the first document 301 is not rotated when formed on a recording medium 303, and this recording medium 303 is ejected with the Z-fold. The image of the second document 302 is rotated by 90 degrees when formed on a recording medium 304, and this recording medium 304 is ejected without the Z-fold.

The main scanning width of the A3-size differs from that of the B4-size, and the main scanning width of the A3-size also differs from the sub scanning width of the B4-size. Hence, the image of the first document 305 is not rotated when formed on a recording medium 307, and this recording medium 307 is ejected with the Z-fold. The image of the second document 306 is not rotated when formed on a recording medium 308, and this recording medium 308 is ejected with the Z-fold.

The Z-fold function may be used in combination with a staple function and/or a punch function.

FIGS. 20 and 21 are diagrams showing staple tables which indicate whether or not the stapling of the recording medium by the stapler included in the other hardware resources 24 is possible. The staple tables shown in FIGS. 20 and 21 may be stored in a suitable memory or storage part of the composite apparatus 1, such as the memories 32 and 37 and the HDD 38, and referred to when using the staple function in combination with the Z-fold function.

In FIGS. 20 and 21, "O" indicates that the stapling of the recording medium is possible, and "X" indicates that the stapling of the recording medium is not possible. The positions on the recording medium where the stapling is possible depends on the folding direction when the recording medium is subjected to the Z-fold. Further, the columns indicate the positions on the recording medium where the stapling may be made, with respect to the right-fold and the bottom-fold which are shown in the rows.

The stapling may normally be made at any of 4 positions on the recording medium, namely, the top left, the bottom left, the top right and the bottom right. It is also possible to staple the recording medium at two positions, namely, the top left and the bottom left (indicated as 2-LEFT) or, the top right and the bottom right (indicated as 2-RIGHT). In addition, the stapling may be made obliquely with respect to the recording medium, as indicated by "OBLIQUE TOP LEFT" which indicates the oblique stapling at the top left, and "OBLIQUE TOP RIGHT" which indicates the oblique stapling at the top right. The stapling may also be made at the left center (or right center) of the recording medium as shown in FIG. 21.

FIG. 22 is a diagram showing a punch table which indicates whether or not the punching of the recording medium by the puncher included in the other hardware resources 24 is possible. The punch table shown in FIG. 22 may be stored in a suitable memory or storage part of the composite apparatus 1, such as the memories 32 and 37 and the HDD 38, and referred to when using the staple function in combination with the Z-fold function.

In FIG. 22, "O" indicates that the punching of the recording medium is possible, and "X" indicates that the punching of the recording medium is not possible. The positions on the recording medium where the punching is possible depends on the folding direction when the recording medium is subjected to the Z-fold. Further, the columns indicate the positions on the recording medium where the punching may be made, with respect to the right-fold and the bottom-fold which are shown in the rows.

The punching may normally be made at any of 3 positions on the recording medium, namely, the top, the right and the left. The punching may form one or a plurality of holes in the recording medium. In addition, the holes formed by the punching may have the same size or, have different sizes. Moreover, the size of the holes formed by the punching may differ depending on the position on the recording medium where the punching is made.

Of course, a computer-readable storage medium which stores a program for causing a computer to carry out the Z-fold method of the present invention, also falls within the scope of the present invention. The computer-readable storage medium itself may be made of any kind of computer-readable recording media such as magnetic recording media, magneto-optic recording media, optical recording media, and semiconductor memory devices.

Further, the present invention is not limited to these embodiments, but various variations and modifications may be made without departing from the scope of the present invention.

What is claimed is:

1. An image forming apparatus comprising:

an orientation setting part configured to set a readable horizontal or vertical document orientation, which enables a user of the image forming apparatus to readily read and understand an image on the document when carrying out an image forming process to form the image on a recording medium;

a folding direction setting part configured to set a folding direction in which a Z-fold of the recording medium is to be made after the image forming process; and a Z-fold part configured to form the Z-fold on the recording medium, based on the readable orientation and the folding direction, wherein the Z-fold part, when forming the Z-fold on a plurality of recording media with respect to documents having mixed sizes, rotates document data read from a first document based on the document orientation set by the orientation setting part and the folding direction set by the folding direction setting part, and rotates document data read from a document other than the first document based on a main scanning width of the recording medium on which the document data of the first document is formed and a main scanning width or a sub scanning width of the document data read from the document other than the first document, and wherein the Z-fold part outputs the document data read from the first document on a recording medium elongated in a horizontal direction after rotating the document data in a predetermined direction, if the first document is elongated in a vertical direction, the document orientation is set to the horizontal direction by the orientation setting part, and the folding direction is set to a bottom-fold by the folding direction setting part; and the Z-fold part outputs the document data read from the first document on a recording medium elongated in the horizontal direction after rotating the document data in a predetermined direction and folds a longer side of the recording medium by a right-fold, if the first document is elongated in the horizontal direction, the document orientation is set to the vertical direction by the orientation setting part, and the folding direction is set to a right-fold by the folding direction setting part.

2. The image forming apparatus as claimed in claim 1, wherein the Z-fold part includes:

a rotating part configured to rotate the document data read from the first document; and a judging part configured to judge whether a Z-fold can be made on a recording medium on which the document data rotated by the rotating part is output, based on the document orientation set by the orientation setting part and the folding direction set by the folding direction setting part.

3. The image forming apparatus as claimed in claim 1, wherein the Z-fold part includes:

a comparing part configured to compare a main scanning width of a recording medium on which the document read from the first document is output and a main scanning width or a sub scanning width of document data read from the document other than the first document; and a rotating part configured to rotate the document data read from the first document in a predetermined direction based on a comparison result obtained by the comparing part.

4. The image forming apparatus as claimed in claim 3, wherein the Z-fold part outputs the document data read from the document other than the first document after rotating the document data, if the comparison result obtained by the comparing part indicates that the main scanning width of the recording medium on which the document data read from the first document is output is equal to the sub scanning width of the document data read from the document other than the first document.

5. The image forming apparatus as claimed in claim 1, further comprising:

a stapling part configured to staple the recording medium.

6. The image forming apparatus as claimed in claim 5, wherein the stapling part judges whether the recording medium can be stapled based on a stapling position and the folding direction set by the folding direction setting part.

7. The image forming apparatus as claimed in claim 1, further comprising:

a punching part configured to punch one or a plurality of holes in the recording medium.

8. The image forming apparatus as claimed in claim 7, wherein the punching part judges whether the recording medium can be punched based on a stapling position and the folding direction set by the folding direction setting part.

9. The image forming apparatus as claimed in claim 1, wherein recording media sizes on which the Z-fold can be made include at least A4-size.

10. A Z-fold method for an image forming apparatus, comprising:

an orientation setting step setting a readable horizontal or vertical document orientation, which enables an operator of the image forming apparatus to readily read and understand an image on the document when carrying out an image forming process to form the image on a recording medium;

a folding direction setting step setting a folding direction in which a Z-fold of the recording medium is to be made after the image forming process; and a Z-fold step forming the Z-fold on the recording medium, based on the readable orientation and the folding direction, wherein the Z-fold step, when forming the Z-fold on a plurality of recording media with respect to documents having mixed sizes, rotates document data read from a first document based on the document orientation set by the orientation setting step and the folding direction set by the folding direction setting step, and rotates document data read from a document other than the first document based on a main scanning width of the recording medium on which the document data of the first document is formed and a main scanning width or a sub scanning width of the document data read from the document other than the first document, and wherein the Z-fold step outputs the document data read from the first document on a recording medium elongated in a horizontal direction after rotating the document data in a predetermined direction, if the first document is elongated in a vertical direction, the document orientation is set to the horizontal direction by the orientation setting step, and the folding direction is set to a bottom-fold by the folding direction setting step; and the Z-fold step outputs the document data read from the first document on a recording medium elongated in the horizontal direction after rotating the document data in a predetermined direction and folds a longer side of the recording medium by a right-fold, if the first document is elongated in the horizontal direction, the document orientation is set to the vertical direction by the orientation setting step, and the folding direction is set to a right-fold by the folding direction setting step.

11. The Z-fold method as claimed in claim 10, wherein the Z-fold step includes;

rotating the document data read from the first document; and judging whether a Z-fold can be made on a recording medium on which the document data rotated by said rotating is output, based on the document orientation set by the orientation setting step and the folding direction set by the folding direction setting step.

12. The Z-fold method as claimed in claim 11, wherein said rotating includes:

judging whether the document elongated in the vertical or horizontal direction has an image with a horizontal orientation or a vertical orientation;

judging whether the Z-fold is a right-fold or a bottom-fold; and rotating the document data in the predetermined direction based on said judging document image orientation and said judging the Z-fold.

13. The Z-fold method as claimed in claim 10, wherein the Z-fold step includes:

comparing a main scanning width of a recording medium on which the document read from the first document is output and a main scanning width or a sub scanning width of document data read from the document other than the first document; and rotating the document data read from the first document in a predetermined direction based on a comparison result obtained by said comparing.

14. The Z-fold method as claimed in claim 13, wherein the Z-fold step outputs the document data read from the document other than the first document after rotating the document data, if the comparison result obtained by said comparing indicates that the main scanning width of the recording medium on which the document data read from the first document is output is equal to the sub scanning width of the document data read from the document other than the first document.

15. The Z-fold method as claimed in claim 10, further comprising:

a stapling step stapling the recording medium.

16. The Z-fold method as claimed in claim 15, wherein the stapling step judges whether the recording medium can be stapled based on a stapling position and the folding direction set by the folding direction setting step.

17. The Z-fold method as claimed in claim 10, further comprising:

a punching step punching one or a plurality of holes in the recording medium.

18. The Z-fold method as claimed in claim 17, wherein the punching step judges whether the recording medium can be punched based on a stapling position and the folding direction set by the folding direction setting step.

19. The Z-fold method as claimed in claim 10, wherein recording media sizes on which the Z-fold can be made include at least A4-size.

20. A computer-readable storage medium which stores a program which, when executed by a computer, causes the computer to perform a Z-fold process in an image forming apparatus, said program comprising:

an orientation setting procedure causing the computer to set a readable horizontal or vertical document orientation, which enables an operator of the image forming apparatus to readily read and understand an image on the document when carrying out an image forming process to form the image on a recording medium;

a folding direction setting procedure causing the computer to set a folding direction in which a Z-fold of the recording medium is to be made after the image forming process; and a Z-fold procedure causing the computer to form the Z-fold on the recording medium, based on the readable orientation and the folding direction, wherein the Z-fold procedure, when forming the Z-fold on a plurality of recording media with respect to documents having mixed sizes, causes the computer to rotate document data read from a first document based on the document orientation set by the orientation setting procedure and the folding direction set by the folding direction setting procedure, and to rotate document data read from a document other than the first document based on a main scanning width of the recording medium on which the document data of the first document is formed and a main scanning width or a sub scanning width of the document data read from the document other than the first document, and wherein the Z-fold procedure causes the computer to output the document data read from the first document on a recording medium elongated in a horizontal direction after rotating the document data in a predetermined direction, if the first document is elongated in a vertical direction, the document orientation is set to the horizontal direction by the orientation setting step, and the folding direction is set to a bottom-fold by the folding direction setting step; and the Z-fold procedure causes the computer to output the document data read from the first document on a recording medium elongated in the horizontal direction after rotating the document data in a predetermined direction and folds a longer side of the recording medium by a right-fold, if the first document is elongated in the horizontal direction, the document orientation is set to the vertical direction by the orientation setting step, and the folding direction is set to a right-fold by the folding direction setting step.

* * * * *